US010943453B2

(12) United States Patent
Shimadzu

(10) Patent No.: US 10,943,453 B2
(45) Date of Patent: Mar. 9, 2021

(54) ALARM APPARATUS

(71) Applicant: HOCHIKI Corporation, Tokyo (JP)

(72) Inventor: Tomohiko Shimadzu, Tokyo (JP)

(73) Assignee: Hochiki Corporation, Shinagawa-ku (JP)

( * ) Notice: Subject to any disclaimer, the term of this patent is extended or adjusted under 35 U.S.C. 154(b) by 38 days.

(21) Appl. No.: 16/684,411

(22) Filed: Nov. 14, 2019

(65) Prior Publication Data

US 2020/0134999 A1 Apr. 30, 2020

Related U.S. Application Data

(63) Continuation-in-part of application No. PCT/JP2018/018583, filed on May 14, 2018.

(30) Foreign Application Priority Data

Jun. 14, 2017 (JP) ..... 2017-116828

(51) Int. Cl.
*G08B 17/107* (2006.01)

(52) U.S. Cl.
CPC ..... *G08B 17/107* (2013.01)

(58) Field of Classification Search
CPC .... G08B 17/00; G08B 17/107; G08B 17/113; G08B 17/117; G08B 17/12
See application file for complete search history.

(56) References Cited

U.S. PATENT DOCUMENTS 3,681,603 A * 8/1972 Scheidweiler ..... G08B 17/107 250/381
3,985,453 A * 10/1976 Nakano ..... G01N 21/53 356/439

(Continued)

FOREIGN PATENT DOCUMENTS

JP 2010-039936 2/2010
JP 2011174435 A 9/2011

(Continued)

OTHER PUBLICATIONS

Lee et al.,"Distinct role of flexible and stable according in sequential working memory", bioRxiv, Jan. 20, 2019,pp. 1-38.

(Continued)

*Primary Examiner* — Rufus C Point
(74) *Attorney, Agent, or Firm* — Blank Rome LLP

(57) ABSTRACT

A light shielding section for inhibiting ambient light from entering a detection space 34 for detecting smoke contained in a gas is included, the light shielding section includes an inner labyrinth 36 that covers an outer edge of the detection space 34 and has a first inner inflow opening 36*f*, a detector body 4 disposed at a position facing the first inner inflow opening 36*f*, the position being separated from the first inner inflow opening 36*f* by a first gap 38, and an outer labyrinth 37 disposed at a position separated from the first gap 38 by a second gap 39 on an imaginary line orthogonal to a direction in which the first inner inflow opening 36*f* and the detector body 4 face each other, the imaginary line passing through the first gap 38, and the gas outside the light shielding section is allowed to flow into the detection space 34 through the second gap 39, the first gap 38, and the first inner inflow opening 36*f* in order.

6 Claims, 22 Drawing Sheets

(56) References Cited

U.S. PATENT DOCUMENTS

| | | | | |
|---|---|---|---|---|
| 5,302,837 | A * | 4/1994 | Sawa | G08B 17/113 250/574 |
| 6,437,698 | B1 * | 8/2002 | Byrne | G08B 3/10 340/588 |
| 2011/0068936 | A1 | 3/2011 | Shimada et al. | |
| 2016/0305874 | A1 * | 10/2016 | Iguchi | G01D 11/245 |
| 2017/0268994 | A1 * | 9/2017 | Kawai | G01N 21/05 |
| 2018/0322753 | A1 * | 11/2018 | Stibich | G08B 17/107 |
| 2019/0147717 | A1 * | 5/2019 | Shimazu | G08B 17/06 340/628 |
| 2020/0134999 | A1 * | 4/2020 | Shimadzu | G08B 17/107 |
| 2020/0160688 | A1 * | 5/2020 | Shimadzu | G01N 21/534 |

FOREIGN PATENT DOCUMENTS

| | | | |
|---|---|---|---|
| JP | 2011215705 | A * | 10/2011 |
| JP | 2011215705 | A | 10/2011 |
| JP | 2015191562 | A | 11/2015 |
| JP | 2016151787 | A | 8/2016 |

OTHER PUBLICATIONS

International Search Report of International Application No. PCT/JP2018/018583.

* cited by examiner

[Fig. 1]
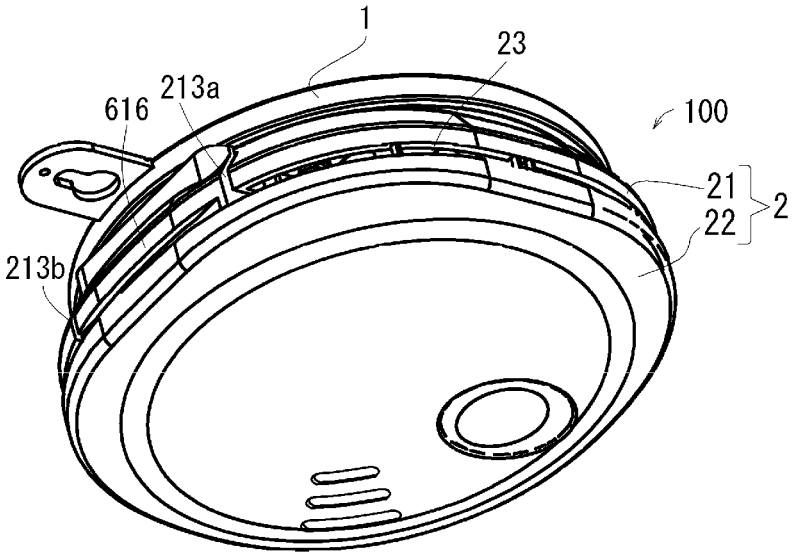
[Fig. 2]
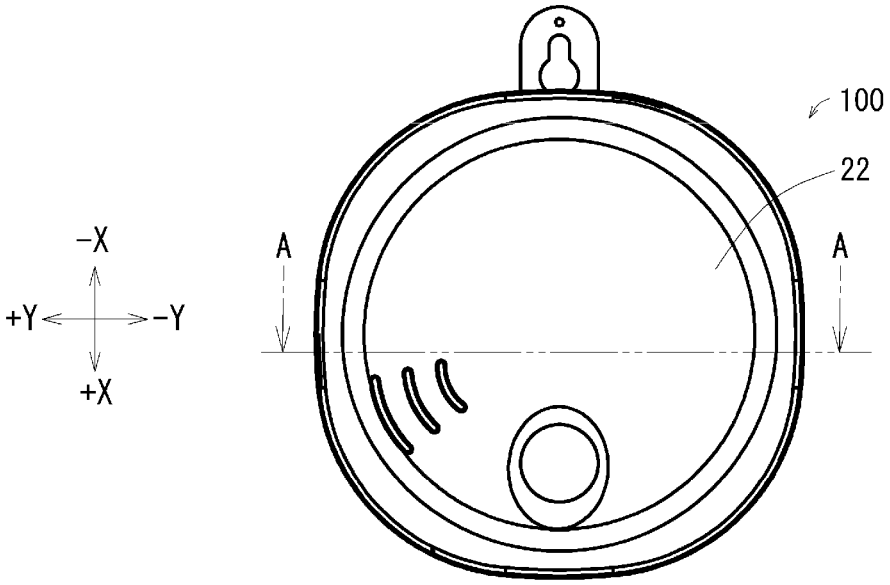

[Fig. 3]
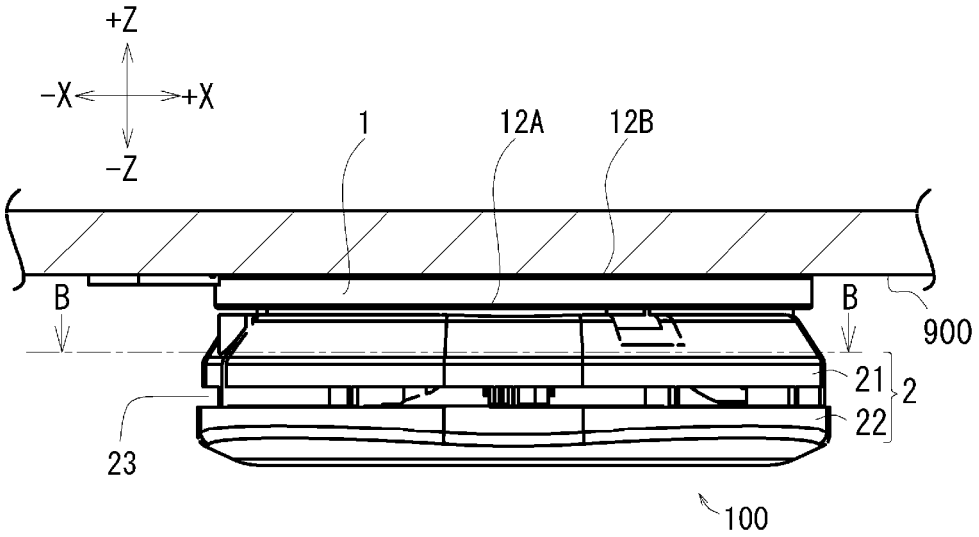
[Fig. 4]
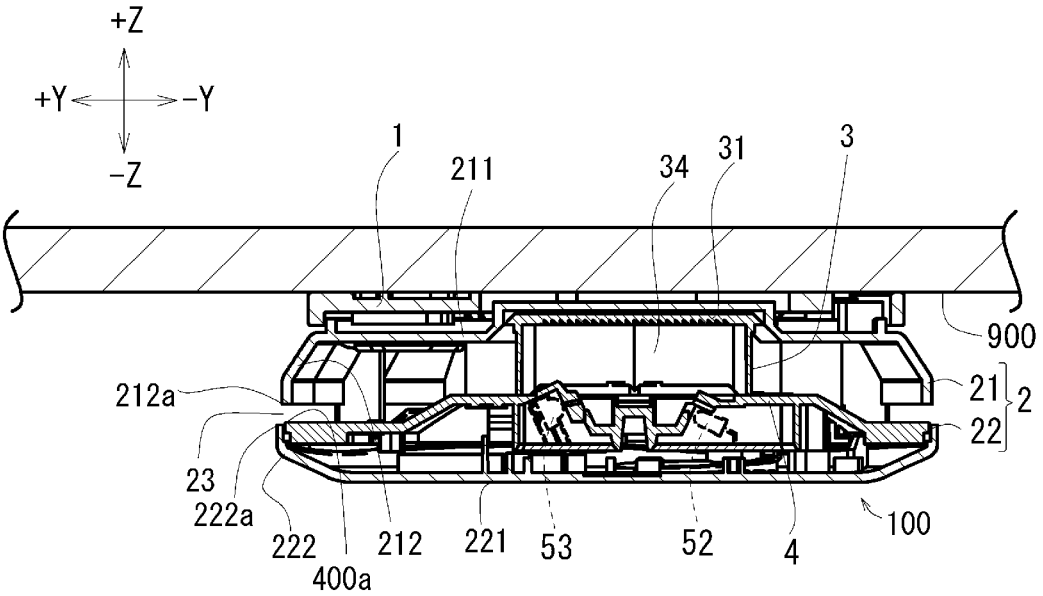

[Fig. 5]
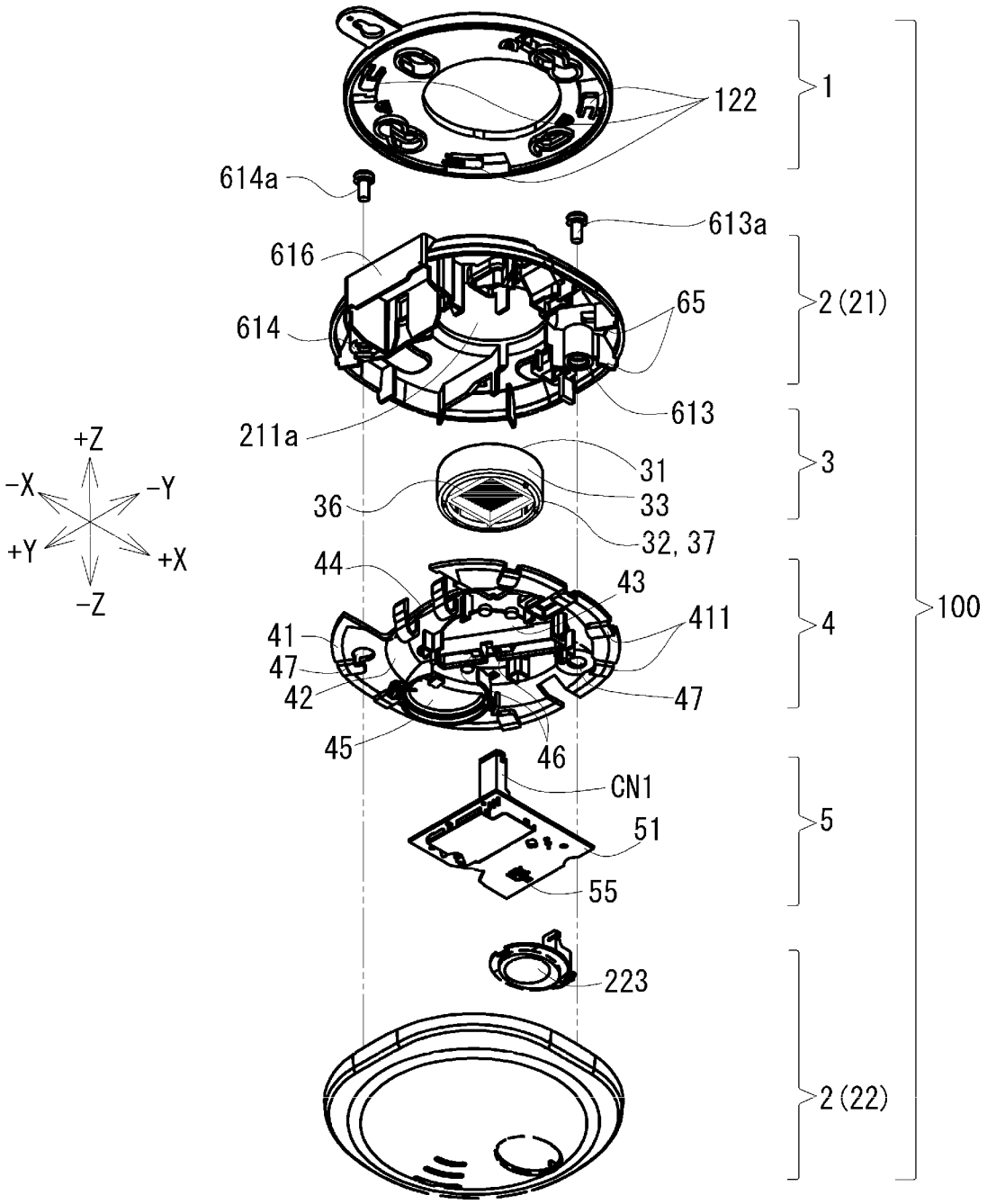

[Fig. 6]
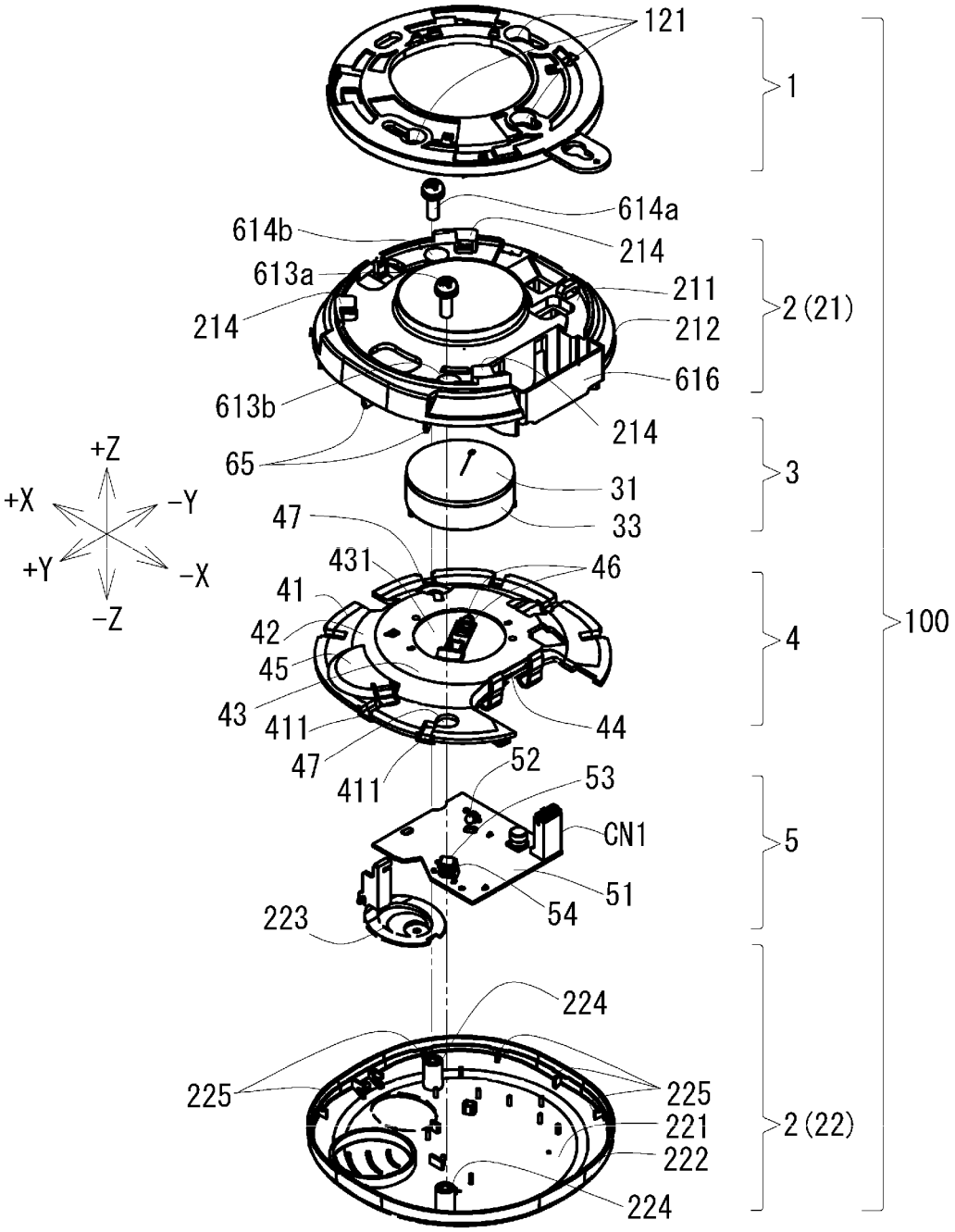

[Fig. 7]
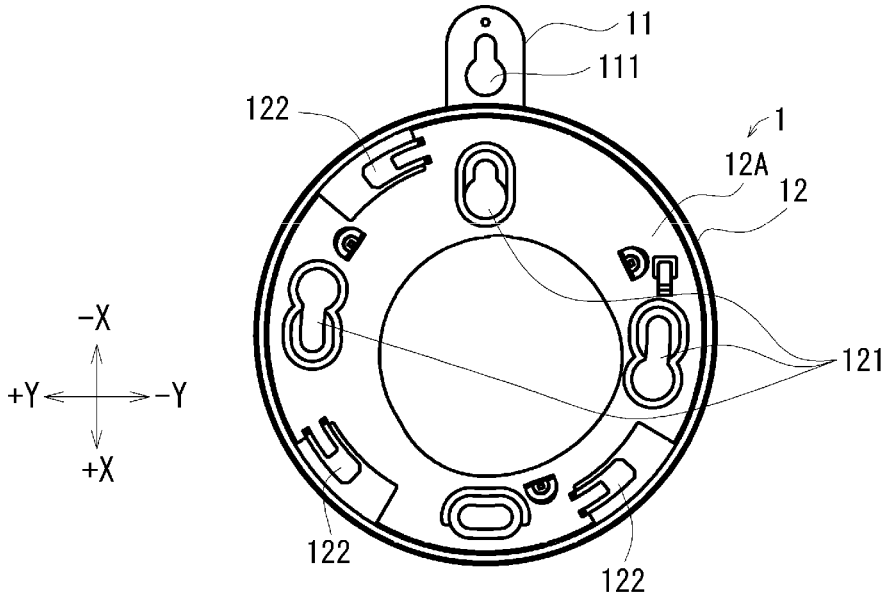
[Fig. 8]
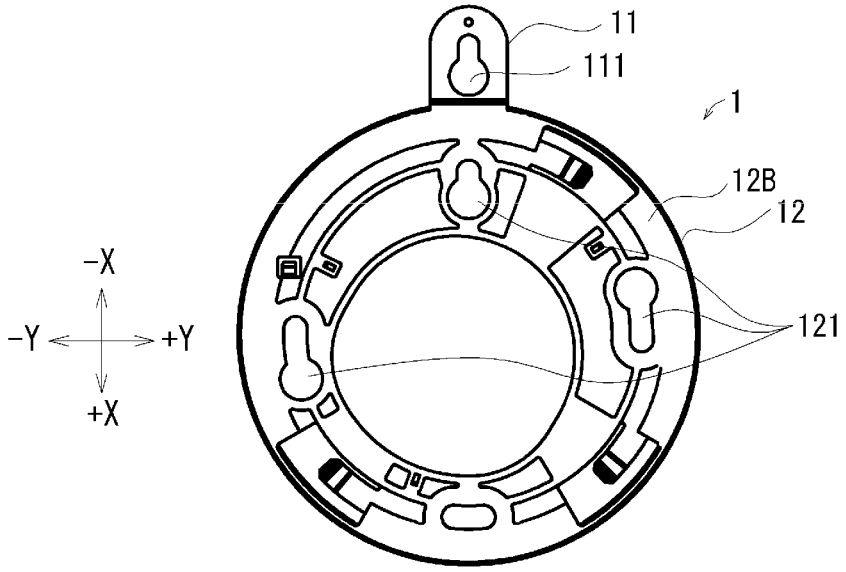

[Fig. 9]
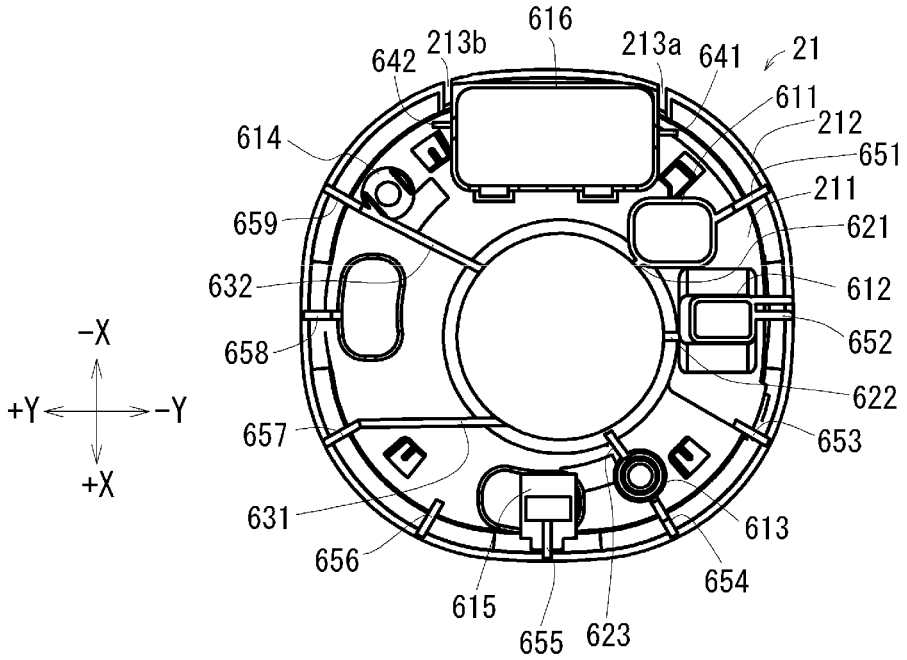
[Fig. 10]
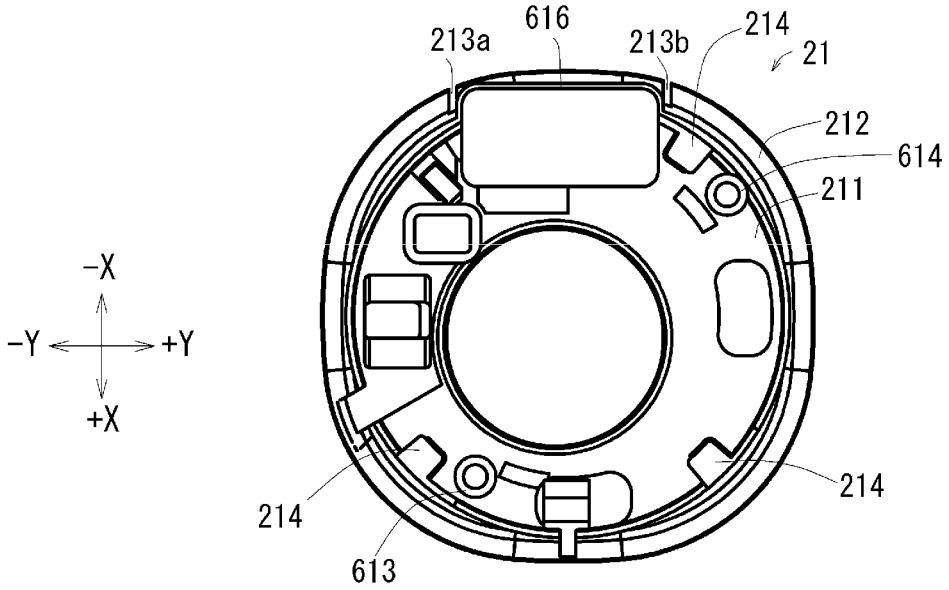

[Fig. 11]
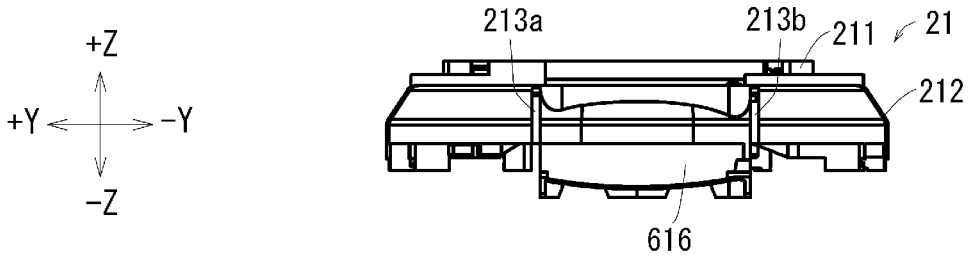
[Fig. 12]
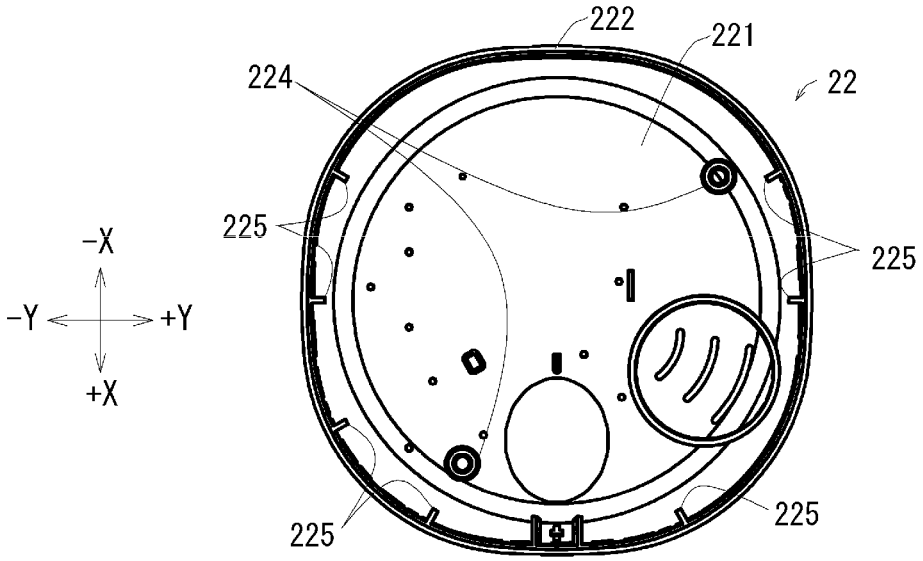

[Fig. 13]
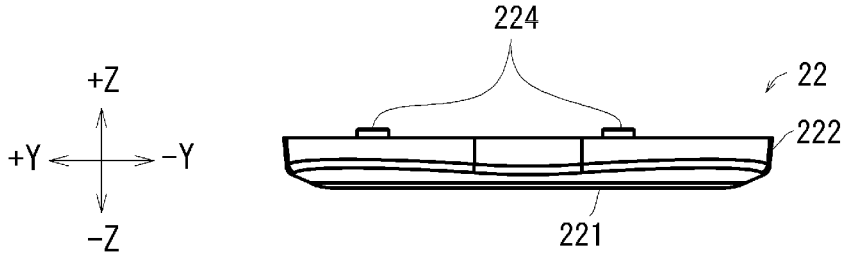
[Fig. 14]
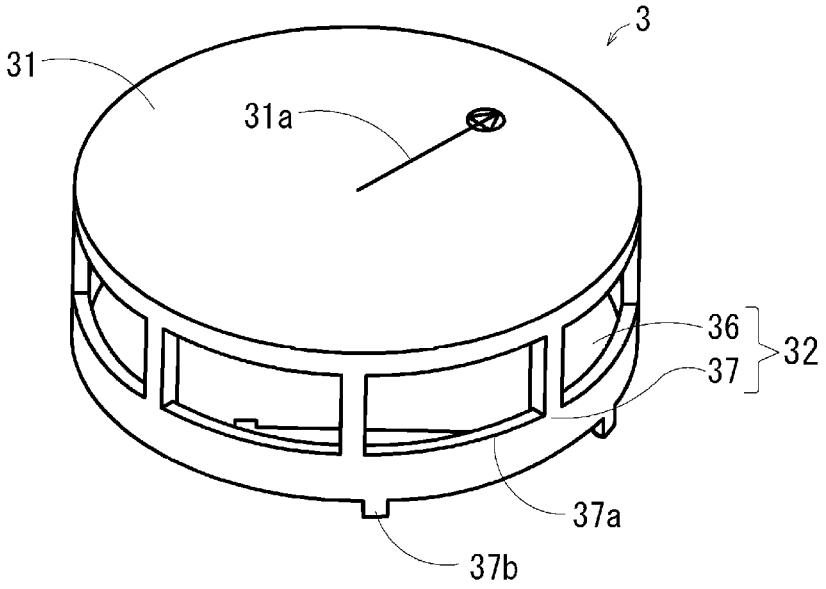

[Fig. 15]
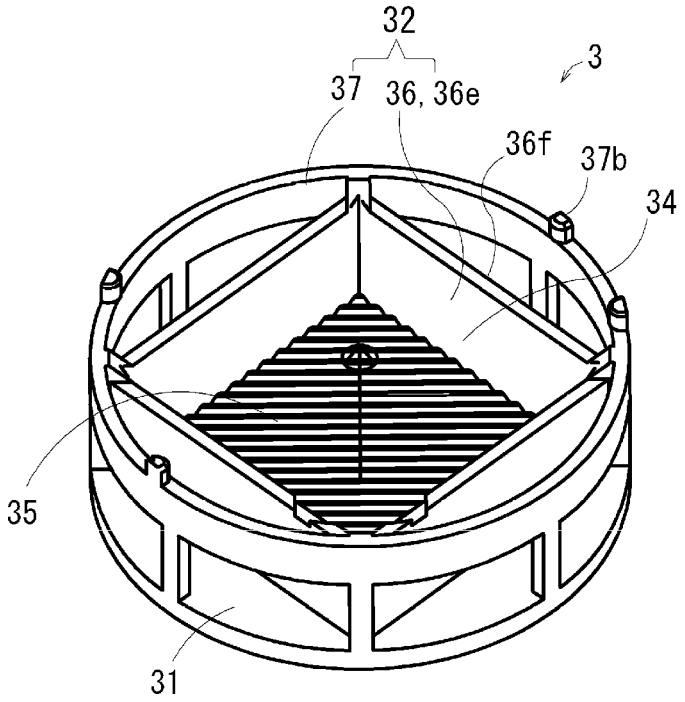
[Fig. 16]
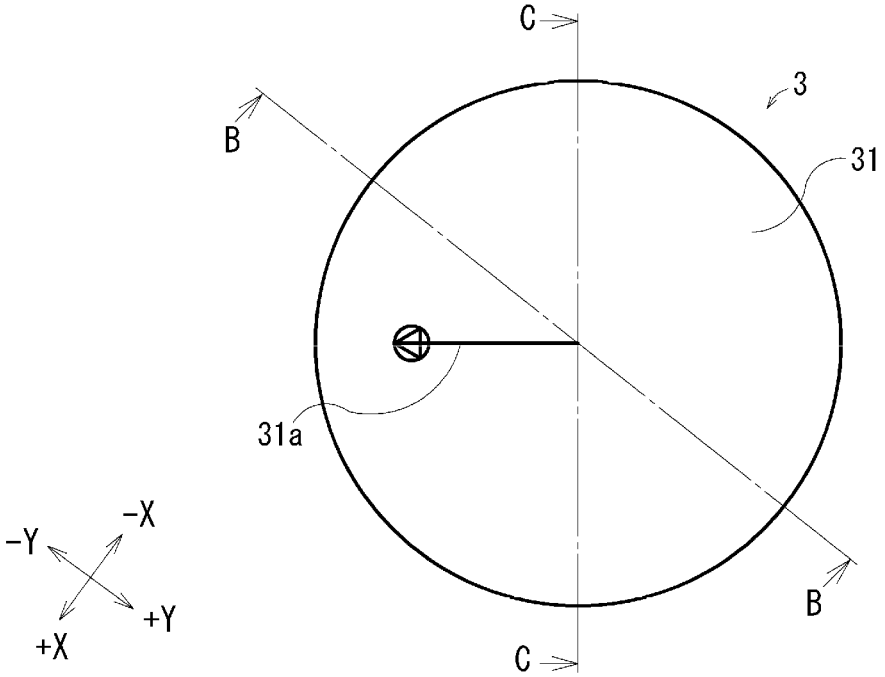

[Fig. 17]
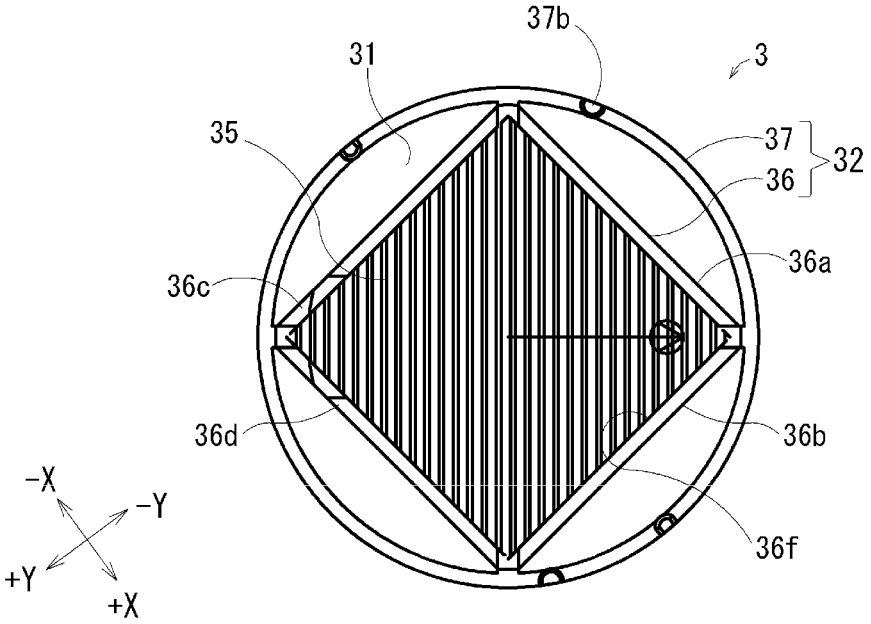
[Fig. 18]
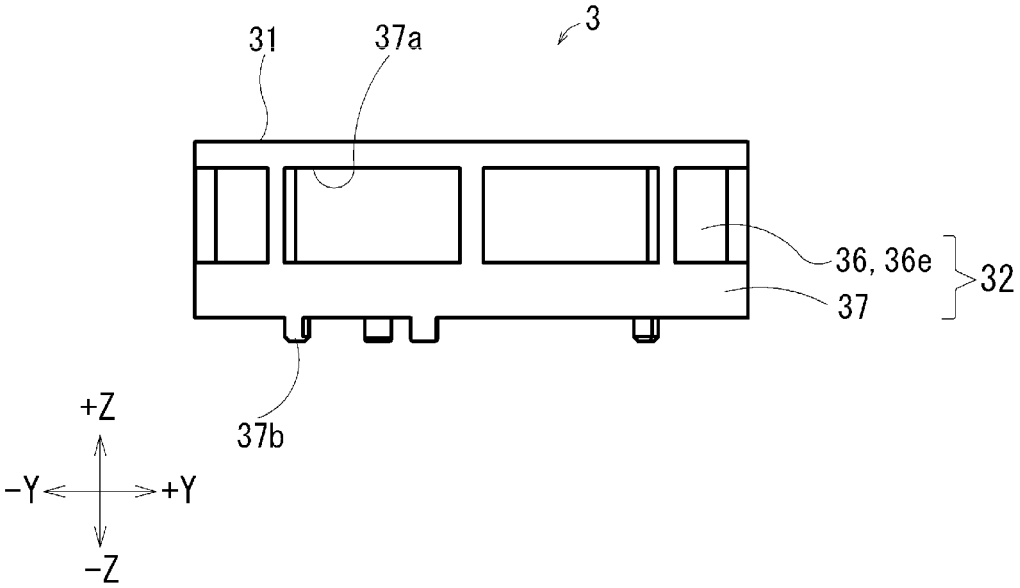

[Fig. 19]
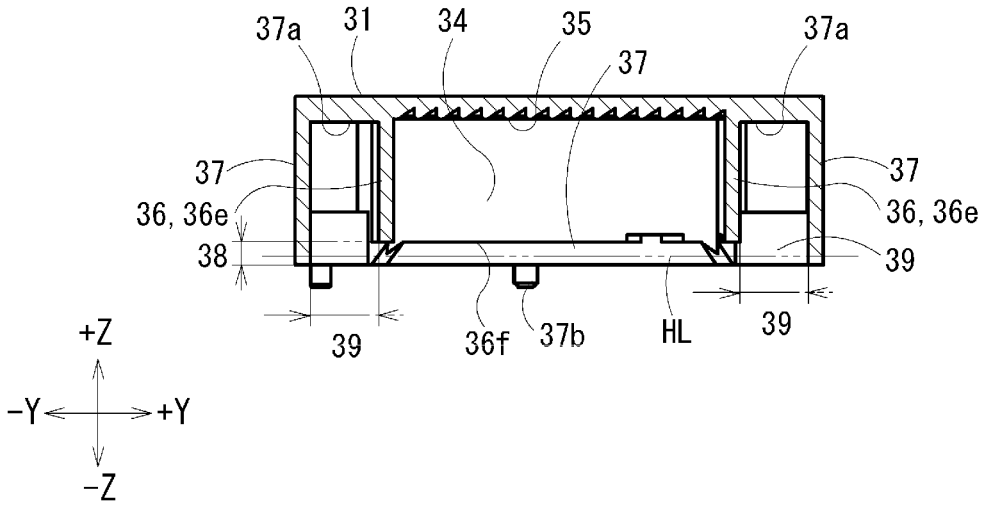
[Fig. 20]
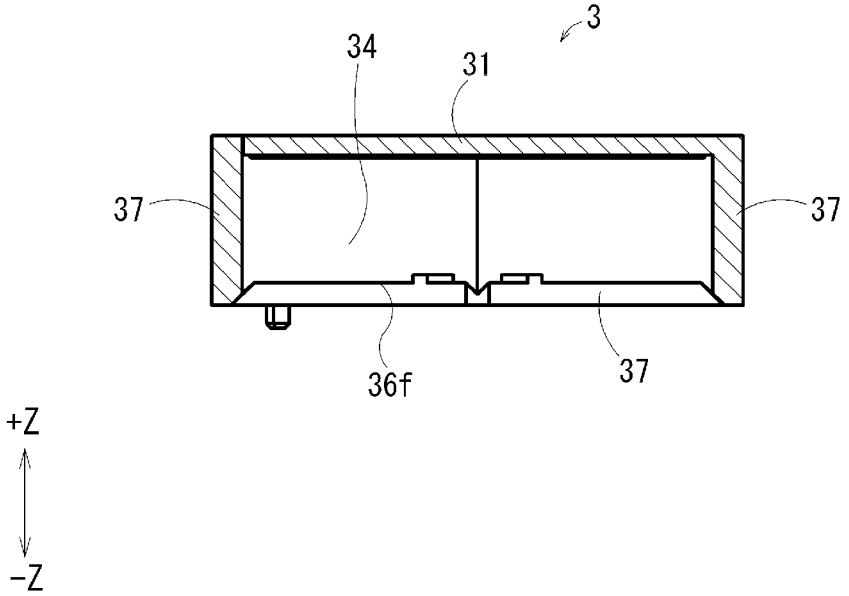

[Fig. 21]
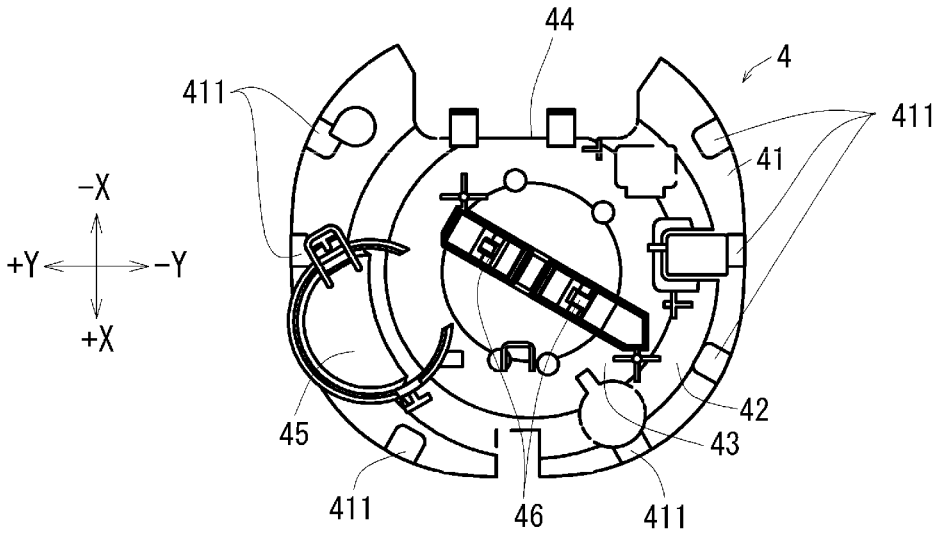
[Fig. 22]
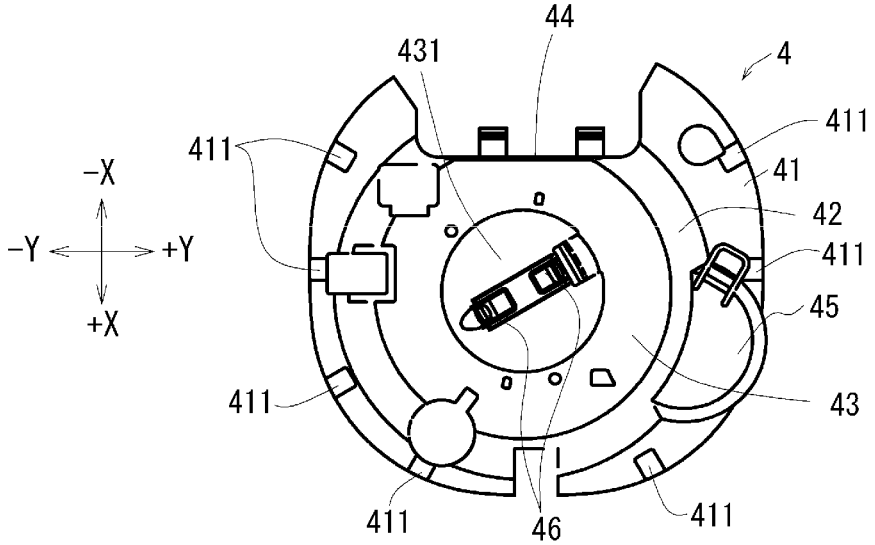

[Fig. 23]
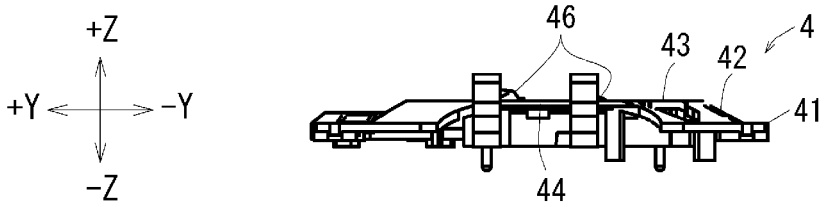
[Fig. 24]
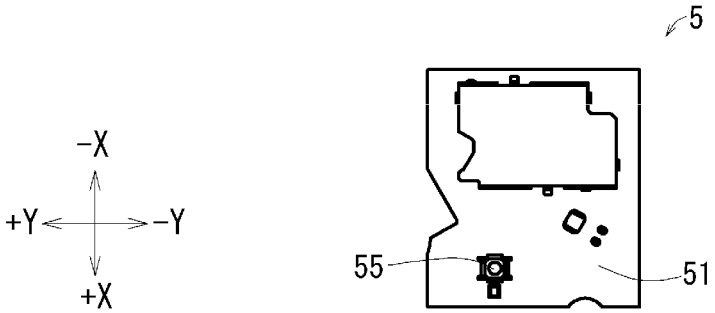

[Fig. 25]
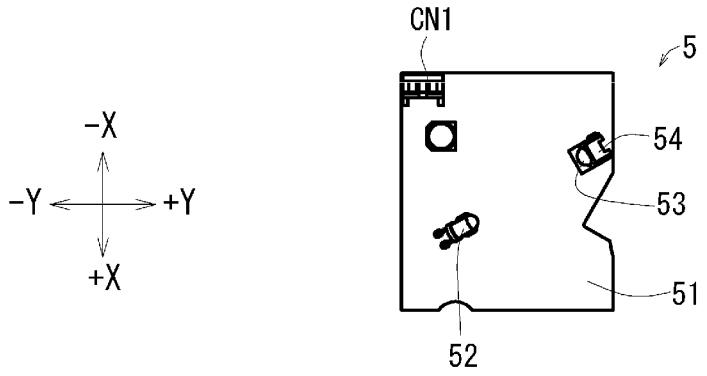
[Fig. 26]
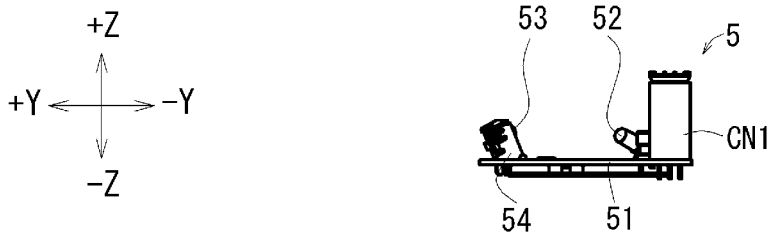

[Fig. 27]
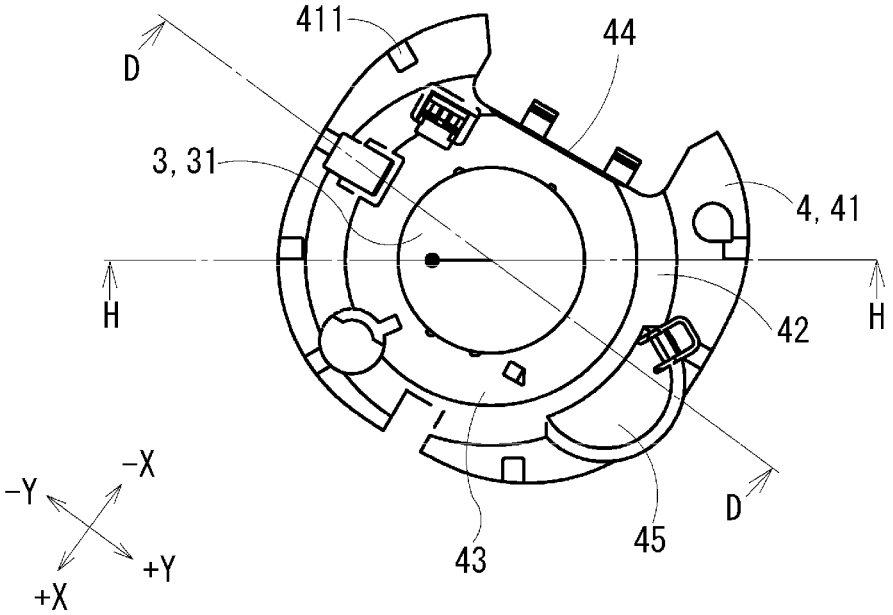
[Fig. 28]
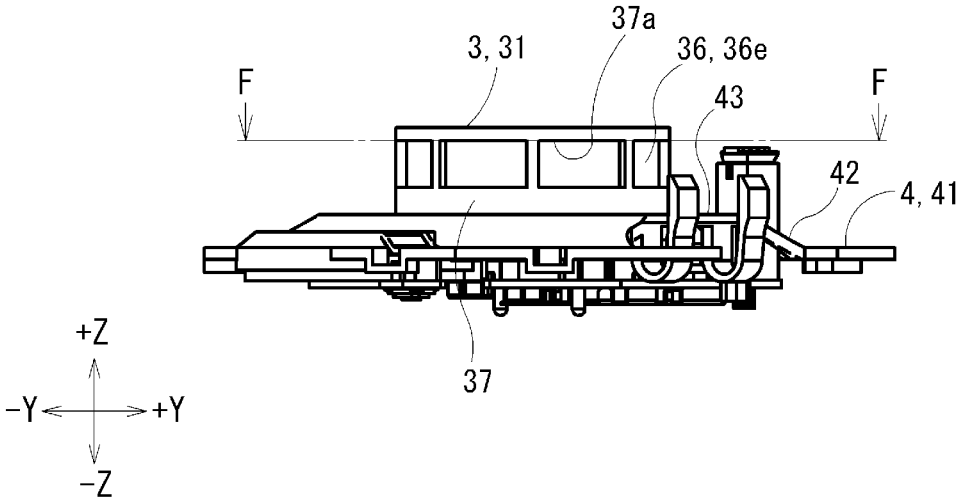

[Fig. 29]
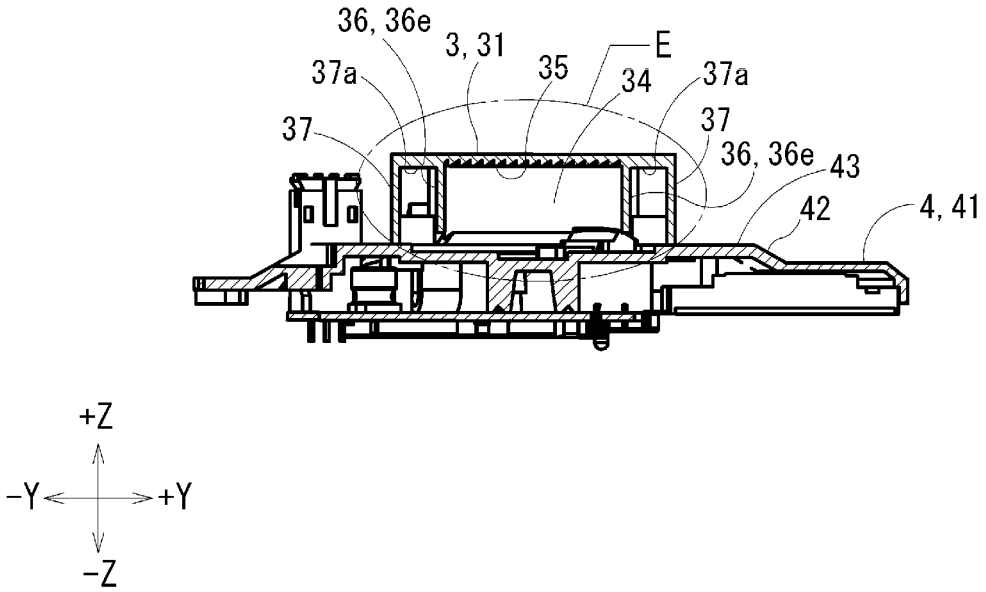
[Fig. 30]
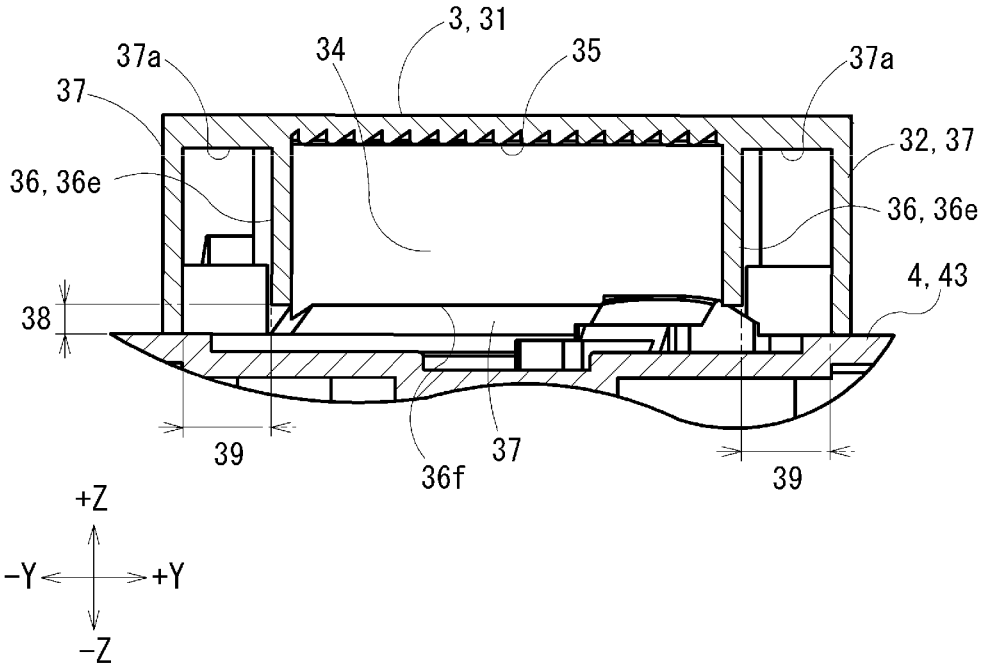

[Fig. 31]
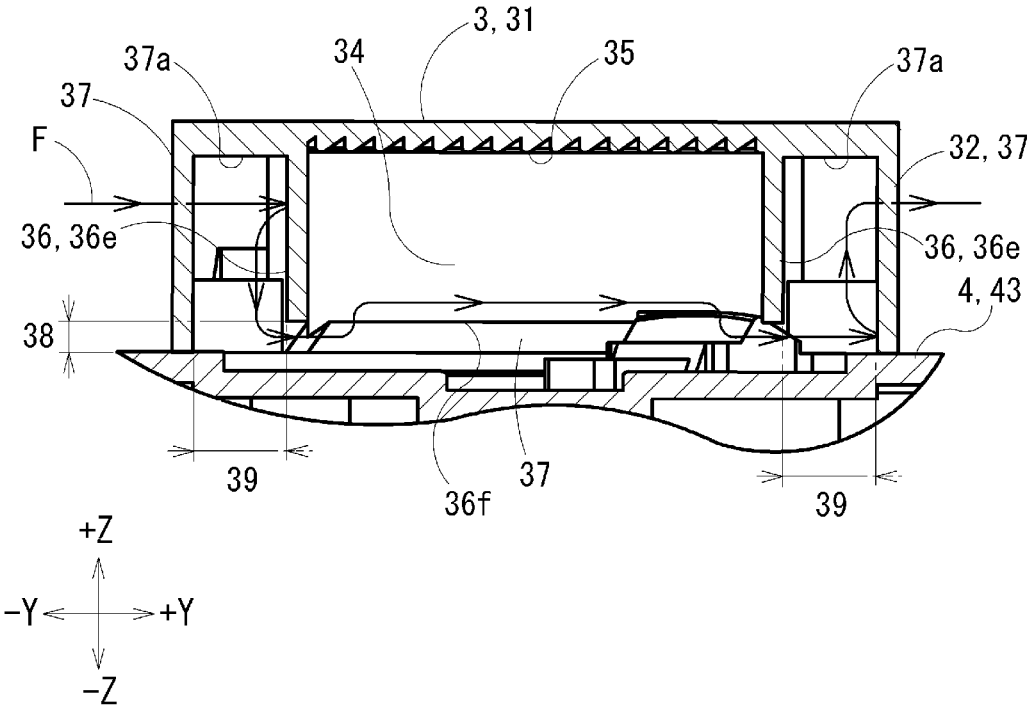
[Fig. 32]
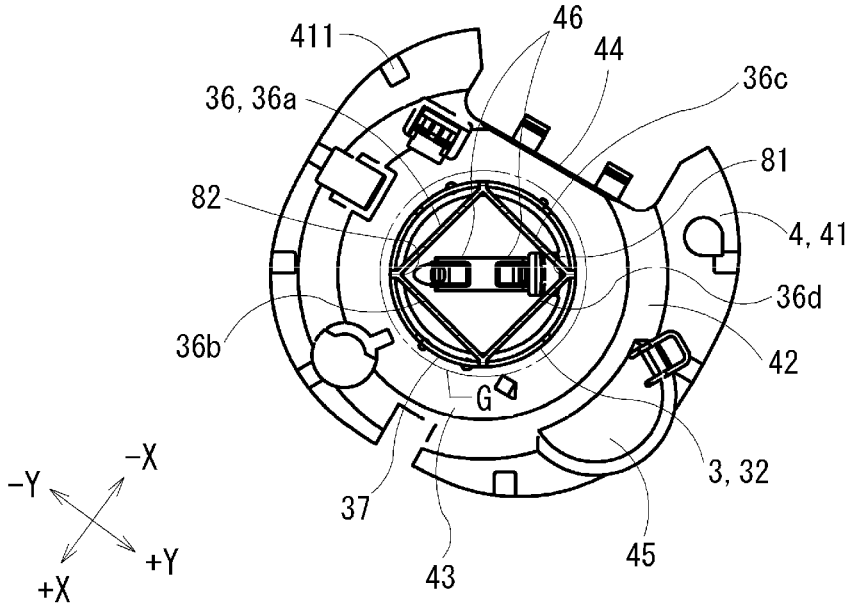

[Fig. 33]
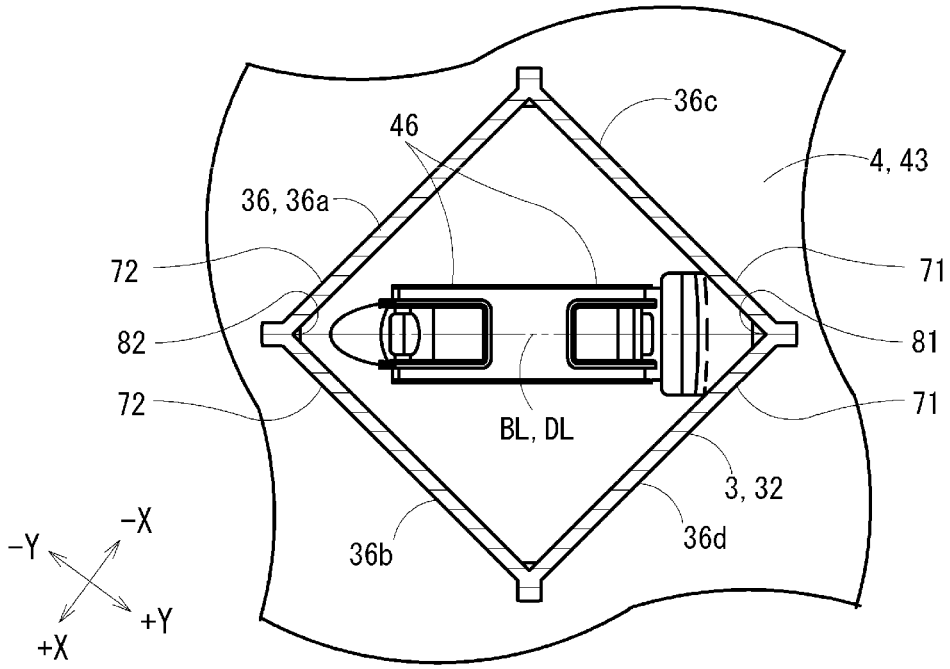
[Fig. 34]
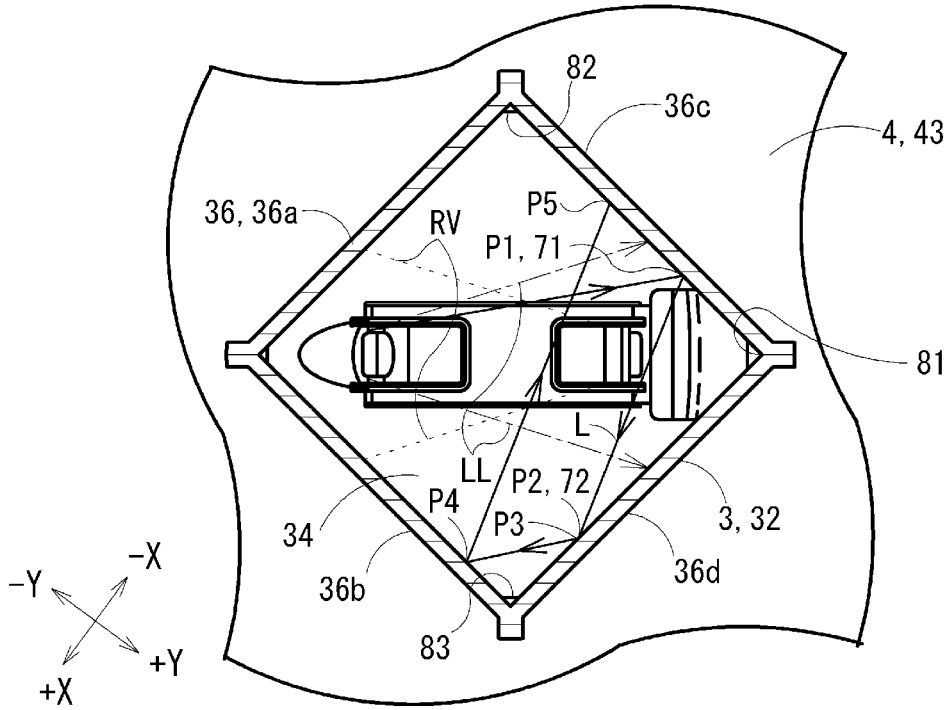

[Fig. 39]
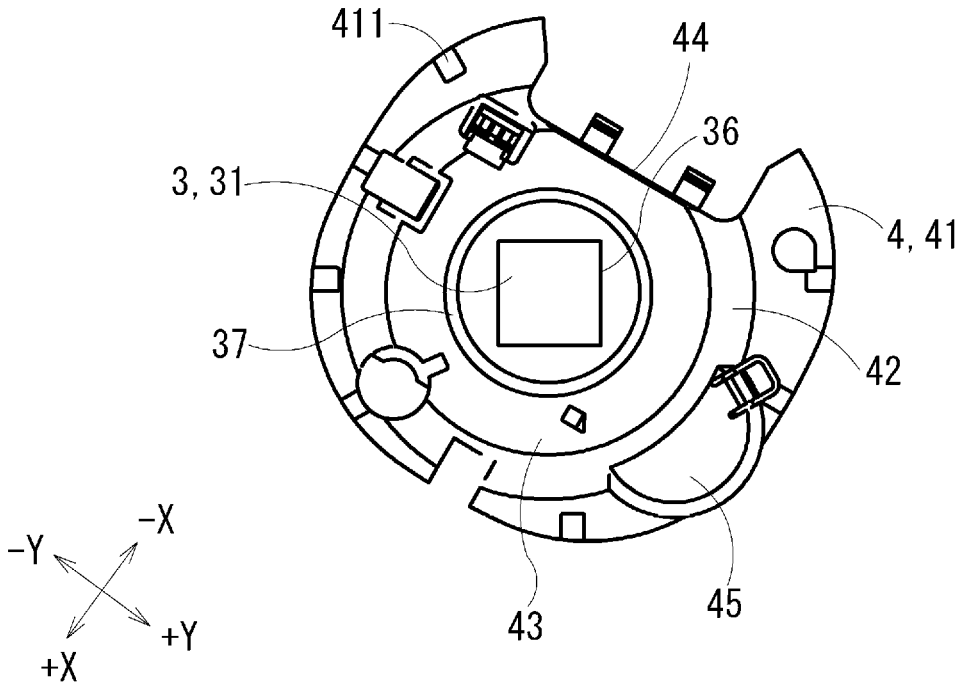

ALARM APPARATUS

CROSS REFERENCE TO RELATED APPLICATIONS

The present application claims the benefit of Patent Application in Japan No. 2017-116828 filed on Jun. 14, 2017 and the benefit of PCT application No. PCT/JP2018/018583 filed on May 14, 2018, the disclosure of which is incorporated by reference its entirety.

INCORPORATION BY REFERENCE

All publications and patent applications mentioned in this specification are herein incorporated by reference in their entirety to the same extent as if each individual publication or patent application was specifically and individually indicated to be incorporated by reference.

TECHNICAL FIELD

The present invention relates to an alarm apparatus.

BACKGROUND ART

Conventionally, there has been a known alarm installed on an installation surface in a monitored area to issue a warning by detecting smoke in the monitored area (for example, Patent Document 1). The alarm includes a housing, a detection unit, and a circuit unit. Among these components, the housing accommodates the detection unit and the circuit unit, and an opening for allowing smoke in the monitored area to flow into the housing is provided on a side wall of the housing. In addition, the detection unit detects smoke and includes a plurality of labyrinth walls, a light emitting unit, and a light receiving unit. Here, the plurality of labyrinth walls covers a space for detecting smoke (hereinafter referred to as a "detection space"), and is provided with a gap therebetween. In addition, the light emitting unit irradiates light toward the detection space. In addition, when light irradiated from the light emitting unit is scattered by particles of smoke flowing into the detection space, the light receiving unit receives the scattered light. In addition, the circuit unit includes a control unit that controls each operation of the alarm. Further, when the amount of light received by the light receiving unit exceeds a predetermined threshold, the circuit unit determines that a fire has broken out in the monitored area.

CITATION LIST

Patent Document

Patent Document 1: Laid-open Patent Application Publication in Japan No. 2010-39936

SUMMARY OF THE INVENTION

Technical Problem

Here, the plurality of labyrinths has the ability to inhibit ambient light from entering the detection space (hereinafter referred to as "light shielding ability") and the ability to allow smoke to flow into the detection space (hereinafter referred to as "gas inflow ability"), but these abilities are determined by a width of a gap provided between adjacent labyrinth walls. For this reason, for example, in a case in which the width of the gap is narrowed, even though the light shielding ability can be improved, the gas inflow ability is degraded. In addition, in a case in which the width of the gap is widened, even though the gas inflow ability can be improved, the light shielding ability is degraded. Thus, there is a possibility that a degree of freedom in design of the plurality of labyrinths may be limited.

It is an object of the present invention to solve the problems of the above mentioned prior arts.

One aspect of the present invention provides an alarm apparatus comprising: a light shielding section for inhibiting ambient light from entering a detection space for detecting a substance to be detected contained in a gas, wherein the light shielding section includes a first light shielding section that covers an outer edge of the detection space and has a first opening, a second light shielding section disposed at a position facing the first opening, the position being separated from the first opening by a first gap, and a third light shielding section disposed at a position separated from the first gap by a second gap on an imaginary line orthogonal to a direction in which the first opening and the second light shielding section face each other, the imaginary line passing through the first gap, and the gas outside the light shielding section is allowed to flow into the detection space through the second gap, the first gap, and the first opening in order.

BRIEF DESCRIPTION OF THE DRAWINGS

FIG. 1 is a perspective view of an alarm apparatus according to the present embodiment.

FIG. 2 is a bottom view of the alarm apparatus.

FIG. 3 is a side view of the alarm apparatus.

FIG. 4 is a cross-sectional view taken along A-A line of FIG. 2.

FIG. 5 is an exploded perspective view of the alarm apparatus viewed from a lower side.

FIG. 6 is an exploded perspective view of the alarm apparatus viewed from an upper side.

FIG. 7 is a bottom view of an attachment base.

FIG. 8 is a plan view of the attachment base.

FIG. 9 is a bottom view of a back case.

FIG. 10 is a plan view of the back case.

FIG. 11 is a front view of the back case.

FIG. 12 is a plan view of a front case.

FIG. 13 is a front view of the front case.

FIG. 14 is a perspective view of a detector cover (insect screen is not illustrated) viewed from an upper side.

FIG. 15 is a perspective view of the detector cover (insect screen is not illustrated) viewed from a lower side.

FIG. 16 is a plan view of the detector cover (insect screen is not illustrated).

FIG. 17 is a bottom view of the detector cover (insect screen is not illustrated).

FIG. 18 is a side view of the detector cover (insect screen is not illustrated).

FIG. 19 is a cross-sectional view taken along B-B line of FIG. 16.

FIG. 20 is a cross-sectional view taken along C-C line of FIG. 16.

FIG. 21 is a bottom view of a detector body.

FIG. 22 is a plan view of the detector body.

FIG. 23 is a front view of the detector body.

FIG. 24 is a bottom view of a circuit unit.

FIG. 25 is a plan view of the circuit unit.

FIG. 26 is a front view of the circuit unit.

FIG. 27 is a plan view illustrating a state in which the detector cover (insect screen is not illustrated) is attached to the detector body.

FIG. 28 is a side view illustrating the state in which the detector cover (insect screen is not illustrated) is attached to the detector body.

FIG. 29 is a cross-sectional view taken along D-D line of FIG. 27.

FIG. 30 is an enlarged view of a part around an area E of FIG. 29.

FIG. 31 is a diagram illustrating a flow of gas in FIG. 30.

FIG. 32 is a cross-sectional view taken along F-F line of FIG. 28.

FIG. 33 is an enlarged view of a part around an area G of FIG. 32 (outer labyrinth is not illustrated).

FIG. 34 is a diagram illustrating internal reflection of detection light in FIG. 33.

FIGS. 38A and 38B are diagrams illustrating another modification of the configuration of the detector cover, in which FIG. 38A is a plan view and FIG. 38B is a cross-sectional view taken along I-I line of FIG. 38A.

FIG. 39 is a plan view illustrating another modification of the configuration of the detector cover.

Figure 35:
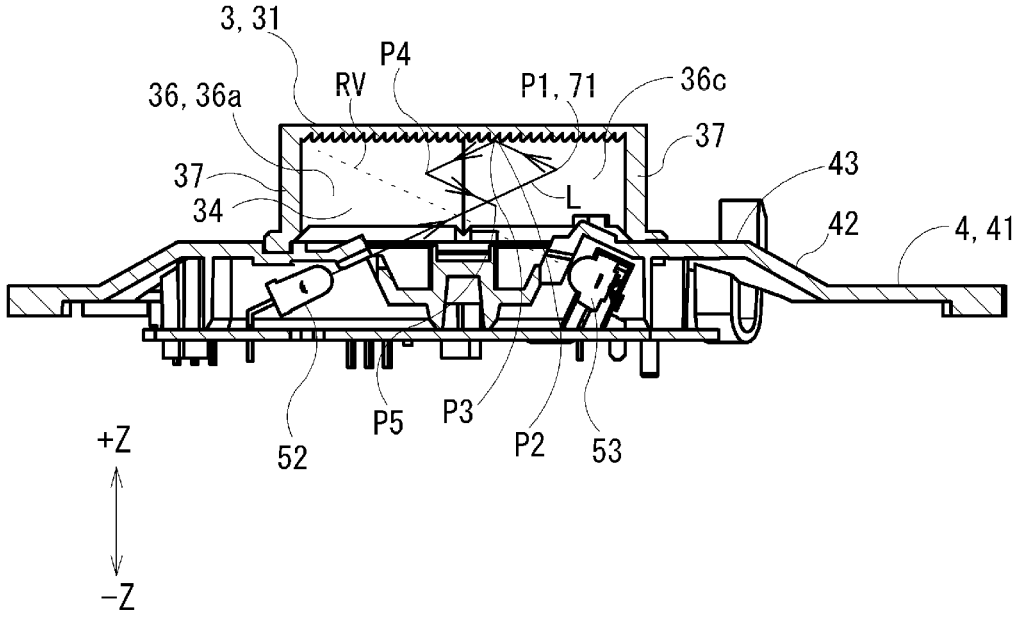
FIG. 35 is a cross-sectional view taken along H-H line of FIG. 27, and is another diagram illustrating internal reflection of detection light.

Hereinafter, an embodiment of an alarm apparatus according to the invention will be described in detail on the basis of drawings. Incidentally, the invention is not limited by this embodiment.

BASIC CONCEPT OF EMBODIMENT

First, a basic concept of the embodiment will be described. The embodiment generally relates to an alarm apparatus attached to an installation surface corresponding to an installation object, and relates to an alarm apparatus having an attachment surface facing the installation surface. Here, the "alarm apparatus" is an apparatus that issues a warning, specifically is an apparatus that performs detection, reporting, or a warning about a substance to be detected contained in gas in a monitored area, and corresponds to, for example, a concept including not only a gas alarm or a fire alarm (smoke alarm) having a reporting function or a warning function in addition to a detection function, but also a gas detector, a fire detector (smoke detector), etc. having only at least a part of a detection function, a reporting function, or a warning function with regard to a substance to be detected. In addition, an alarm method of the alarm apparatus is arbitrary. For example, the alarm method corresponds to a method of outputting information indicating that a threshold or more of a substance to be detected has been output (hereinafter referred to as "alarm information") through a display section or a sound output section, transmitting a signal including alarm information to another apparatus (as an example, a receiver provided in a management room, etc.) through a transmission section, etc. The "monitored area" is an area to be monitored, specifically is an area in which the alarm apparatus is installed, and corresponds to, for example, a concept including an area in a house (for example, a room, etc.), an area in a building other than the house, etc. In addition, the "installation object" is an object on which the alarm apparatus is installed, and examples thereof include a ceiling and a wall in the monitored area. In addition, the "installation surface" is a surface of the installation object on which the alarm apparatus is installed, and examples thereof include a surface of the ceiling on the monitored area side (that is, a lower surface of the ceiling), and a surface of the wall on the monitored area side (that is, an interior side of the wall). In addition, the "attachment surface" is a surface provided on the alarm apparatus, and specifically is a surface attached to the installation surface in a state of facing the installation surface. In addition, the "substance to be detected" is a substance corresponding to a detection target, specifically is a substance contained in a gas, and corresponds to, for example, a concept including carbon monoxide, smoke, etc. in the gas.

In the following embodiment, a description will be given of a case in which the "substance to be detected" is "smoke", and the "alarm apparatus" is a "fire alarm (smoke alarm)" that issues a warning on the basis of scattered light due to smoke, and the "monitoring area" is a "room as an area in a house". In addition, as described above, examples of the "installation object" include the "ceiling", and the "wall", and a case in which the "installation object" is the "wall" will be appropriately brought up and described while a case in which the "installation object" is the "ceiling" is illustrated below.

(Configuration)

First, a description will be given of a configuration of the alarm apparatus according to the present embodiment. FIG. 1 is a perspective view of the alarm apparatus according to the present embodiment, FIG. 2 is a bottom view of the alarm apparatus, FIG. 3 is a side view of the alarm apparatus, FIG. 4 is a cross-sectional view taken along A-A line of FIG. 2, FIG. 5 is an exploded perspective view of the alarm apparatus viewed from a lower side, and FIG. 6 is an exploded perspective view of the alarm apparatus viewed from an upper side. Incidentally, in the following description, X-Y-Z directions illustrated in the respective drawings are directions orthogonal to one another. Specifically, the Z direction is a vertical direction (that is, a direction in which gravity acts), and the X direction and the Y direction are horizontal directions orthogonal to the vertical direction. For example, the Z direction is referred to as a height direction, a +Z direction is referred to as an upper side (plane), and a −Z direction is referred to as a lower side (bottom surface). In addition, in an illustrated alarm apparatus 100, terms related to the "X-Y-Z directions" below are convenient expressions for describing a relative positional relationship (or direction), etc. of respective components. In the following description, with reference to a center position of a detection space 34 of a case 2 of FIG. 4, a direction away from the detection space 34 is referred to as an "outer side", and a direction approaching the detection space 34 is referred to as an "inner side".

The alarm apparatus 100 illustrated in each of these drawings is an alarm section that detects smoke corresponding to a substance to be detected contained in gas and issues a warning. Specifically, as illustrated in FIG. 3, the alarm apparatus 100 may be used by being attached to an installation surface 900 corresponding to a surface on a lower side (−Z direction) (that is, a lower surface) of the ceiling in the monitored area or an installation surface (not illustrated) corresponding to a surface on a monitored area side of the wall in the monitored area (that is, an interior side surface of the wall) (hereinafter a wall installation surface). Specifically, the alarm apparatus 100 includes an attachment base 1, a case 2, a detector cover 3 of FIG. 5, a detector body 4, and a circuit unit 5. Incidentally, hereinafter, a description will be given of a case in which the installation surface 900 spreads in a direction along an XY plane (that is, the horizontal direction), and the "wall installation surface" (not illustrated) spreads in a direction orthogonal to the installation surface 900 (that is, the vertical direction). Hereinafter, after describing an overall configuration of the alarm apparatus 100, details of each configuration will be described.

(Configuration—Attachment Base)

First, FIG. 7 is a bottom view of the attachment base, and FIG. 8 is a plan view of the attachment base. The attachment base 1 illustrated in FIG. 3 is an attachment section for attaching the case 2 to the installation surface 900 or the "wall installation surface" (not illustrated), specifically is used between the case 2 and the installation surface 900 or the "wall installation surface" (not illustrated), and more specifically includes an attachment hook 11 and a main body 12 of FIG. 7.

(Configuration—Attachment Base—Attachment Hook)

The attachment hook 11 of FIG. 7 is used to attach (that is, install) the attachment base 1 to the installation surface 900 or the "wall installation surface" (not illustrated), specifically is a protruding piece protruding from the main body 12, and includes, for example, a screw hole 111. The screw hole 111 is a hole into which an attachment screw (not illustrated) for attaching the attachment base 1 is inserted. Further, by continuously inserting the attachment screw into the screw hole 111 and the installation surface 900 or the "wall installation surface" (not illustrated), the attachment base 1 can be attached to the installation surface 900 or the "wall installation surface" (not illustrated).

(Configuration—Attachment Base—Main Body)

The main body 12 of FIG. 7 is a main body of the attachment base 1. For example, the main body 12 spreads in a direction along the XY plane, has a disc shape having a predetermined diameter, is formed integrally with the attachment hook 11, and is made of resin. More specifically, the main body 12 includes a case-side facing surface 12A and an installation surface-side facing surface 12B of FIG. 8. As illustrated in FIG. 3, the case-side facing surface 12A of FIG. 7 is a surface to which the case 2 is attached in a state of facing the case 2, and the installation surface-side facing surface 12B is an attachment surface attached to the installation surface 900 (that is, an attachment surface spreading in the direction along the XY plane) in a state of facing the installation surface 900. In addition, as illustrated in FIG. 7, the main body 12 includes a screw hole 121 and an engagement portion 122. The screw hole 121 is a hole into which an attachment screw (not illustrated) for attaching the attachment base 1 to the installation surface 900 is inserted. Further, by continuously inserting the attachment screw into the screw hole 121 and the installation surface 900, the attachment base 1 can be attached to the installation surface 900. In addition, the engagement portion 122 is an attachment section to which the case 2 of FIG. 3 is attached, and specifically is engaged with an engagement portion 214 of a back case 21 of FIG. 6 described below. An outer diameter of such a main body 12 can be arbitrarily set. For example, a description will be given below on the assumption that the outer diameter is set to a similar size (for example, about 10 cm) to that of an existing attachment base.

(Configuration—Case)

Next, the case 2 of FIG. 3 is an accommodating section that accommodates the detector cover 3, the detector body 4, and the circuit unit 5 (hereinafter objects to be accommodated) of FIG. 5, specifically is attached to the installation surface 900 through the attachment base 1, and more specifically includes the back case 21 and a front case 22 of FIG. 5.

(Configuration—Case—Back Case)

FIG. 9 is a bottom view of the back case, FIG. 10 is a plan view of the back case, and FIG. 11 is a front view of the back case. As illustrated in FIG. 5, the back case 21 of these respective drawings is a first accommodating section that accommodates the "objects to be accommodated" from the attachment base 1 side (that is, the upper side (+Z direction)), and forms a gap as an outer inflow opening 23 of FIG. 3 described below between the front case 22 and the back case 21 by being combined with the front case 22. In addition, the back case 21 is an external guiding section that guides gas moving outside the case 2 of FIG. 4 (incidentally, including gas moving along the installation surface 900) to the inside of the case 2 and an internal guiding section that guides gas moving inside the case 2 to the detection space 34 described below, and specifically forms a flow path of gas between the detector body 4 and the back case 21.

For example, the back case 21 of FIG. 9 to FIG. 11 spreads in the direction along the XY plane, has a disc shape whose diameter is larger than that of the attachment base 1, and is integrally formed as a whole (including an "inner member of the back case 21" described below) and made of resin. More specifically, the back case 21 includes a back case-side facing wall 211 and a back case-side outer circumferential wall 212. The back case-side facing wall 211 of FIG. 4 forms a part that spreads in the direction along the XY plane in back case 21, that is, faces the attachment base 1, and includes a guiding recess 211*a* of FIG. 5. The guiding recess 211*a* is a guiding section that guides gas with respect to the detection space 34 of FIG. 4. In addition, the back case-side outer circumferential wall 212 is a first outer wall forming a part (outer wall) that extends in a height direction (Z direction) in the back case 21, and extends toward the lower side (−Z direction) while spreading outward from an outer edge portion of the back case-side facing wall 211.

In addition, more specifically, the back case 21 of FIG. 9 includes component cases 611 to 616, short fins 621 to 623, long fins 631 and 632, prevention pieces 641 and 642, and ribs 651 to 659 (hereinafter "the component cases 611 to 616, the short fins 621 to 623, the long fins 631 and 632, the prevention pieces 641 and 642, and the ribs 651 to 659" are collectively referred to as "inner members of the back case 21"). First, each of the component cases 611 to 616 is an accommodating section that accommodates a component included in the alarm apparatus 100, and specifically has an accommodation wall that partitions a component accommodation space corresponding to a space for accommodating the component. In addition, each of the component cases 611 to 616 (specifically, accommodation walls of the component cases 611 to 616) is a guiding section that guides gas to the detection space 34 of FIG. 4, and is provided in consideration of an arrangement place of the component, etc. to function as the guiding section. In addition, the short fins 621 to 623 are guiding sections that guide gas to the detection space 34 of FIG. 4, and specifically are protruding pieces protruding and extending from the component cases 611 to 613 of FIG. 9. In addition, the long fins 631 and 632 are guiding sections that guide gas to the detection space 34 of FIG. 4, specifically are pieces extending from the ribs 657 and 659 of FIG. 9 described below, and are sufficiently longer than the short fin 621. In addition, the prevention pieces 641 and 642 are guiding sections that guide gas to the detection space 34 of FIG. 4 and prevention sections for preventing dust contained in gas flowing into the inside through slits 213*a* and 213*b* of FIG. 9 described below from intruding into the detection space 34 of FIG. 4. The ribs 651 to 659 of FIG. 9 are guiding sections that guide gas to the detection space 34, reinforcing sections that reinforce the back case 21, and position determination sections that determine a relative positional relationship in the height direction (Z direction) between the front case 22 and the back case 21 of FIG. 6 (that is, a width of the outer inflow opening 23 of FIG. 3). Specifically, the ribs 651 to 659 partition the inside of the outer inflow opening 23 and the case 2 of FIG. 3, and are provided, for example, on the back case-side facing wall 211. Incidentally, the "width of the outer inflow opening 23" indicates a distance from an upper end to a lower end in the outer inflow opening 23. In addition, in the following description, when the ribs 651 to 659 are not required to be distinguished from one another, the ribs 651 to 659 are collectively referred to as a "rib 65" as appropriate.

(Configuration—Case—Front Case)

FIG. 12 is a plan view of the front case, and FIG. 13 is a front view of the front case. As illustrated in FIG. 5, the front case 22 of these respective drawings is a second accommodating section that accommodates the "object to be accommodated" from the opposite side from the attachment base 1 side (that is, lower side (−Z direction)) with the "object to be accommodated" interposed therebetween, and specifically forms a gap as the outer inflow opening 23 of FIG. 3 between the back case 21 and the front case 22 by being combined with the back case 21. Here, the "outer inflow opening" 23 is an inflow section that allows gas outside the case 2 to flow into the case 2, particularly a first inflow opening that allows gas moving along the installation surface 900 on the outside of the case 2 to flow into the case 2, and a gap formed between the back case 21 and the front case 22 of the case 2 to extend in the direction along the XY plane. A width of the outer inflow opening 23 can be arbitrarily set in consideration of prevention of intrusion of dust, ambient light, or a finger of a user, an impression on the user given by an appearance of the alarm apparatus 100, etc. Here, for example, a description will be given below on the assumption that the width is set to 3 to 5 (mm). In addition, the front case 22 is an external guiding section that guides gas moving outside the case 2 of FIG. 4 (incidentally, including gas moving along the installation surface 900) to the inside of the case 2.

For example, the front case 22 of FIG. 12 and FIG. 13 spreads in the direction along the XY plane, has a disc shape whose diameter is larger than that of the back case 21, and is integrally formed as a whole and made of resin. More specifically, the front case 22 includes a front case-side exposed wall 221 and a front case-side outer peripheral wall 222. First, the front case-side exposed wall 221 forms a part spreading in the direction along the XY plane in the front case 22, that is, is exposed to be visually recognized mainly by the user. In addition, the front case-side outer peripheral wall 222 of FIG. 4 is a second outer wall that forms a part (outer wall) extending in the height direction (Z direction) in the front case 22, and extends toward the upper side (+Z direction) while spreading outward from an outer edge portion of the front case-side exposed wall 221.

In addition, more specifically, the front case 22 of FIG. 6 includes a push button 223, a screw boss 224, and a support 225. First, the push button 223 is an operation section that operates the alarm apparatus 100, and specifically is used to push a switch 55 of the circuit unit 5 of FIG. 5 described below from the outside of the front case 22. Further, the screw boss 224 of FIG. 6 is a position determination section that determines a relative positional relationship in the height direction (Z direction) between the front case 22 and the back case 21 (that is, the width of the outer inflow opening 23 of FIG. 3), and a fixing section that mutually fixes the front case 22 and the back case 21 of FIG. 6. Specifically, the screw boss 224 is provided on a surface on the upper side (+Z) in the front case-side exposed wall 221. For example, the screw boss 224 is provided with a predetermined screw hole and has a pillar shape erected in the height direction (Z direction). In addition, the support 225 is a support section that supports the detector body 4 and specifically corresponds to a plurality of protruding pieces provided on the front case-side outer peripheral wall 222 side on a surface of the front case-side exposed wall 221 on the upper side (+Z).

(Configuration—Detector Cover)

Next, FIG. 14 is a perspective view of the detector cover (insect screen is not illustrated) viewed from the upper side, and FIG. 15 is a perspective view of the detector cover (insect screen is not illustrated) viewed from the lower side. FIG. 16 is a plan view of the detector cover (insect screen is not illustrated), FIG. 17 is a bottom view of the detector cover (insect screen is not illustrated), and FIG. 18 is a side view of the detector cover (insect screen is not illustrated). FIG. 19 is a cross-sectional view taken along B-B line of FIG. 16, and FIG. 20 is a cross-sectional view taken along C-C line of FIG. 16. The detector cover 3 of these respective drawings is a light shielding section for detecting smoke using scattered light. As illustrated in FIG. 5, the detector cover 3 is provided between the back case and the detector body 4, and includes a ceiling plate 31, a labyrinth 32, and an insect screen 33. Incidentally, the "detection space" 34 of FIG. 4 is a space for detecting smoke. The ceiling plate 31 is used to inhibit ambient light from entering the detection space 34. As illustrated in FIG. 14, FIG. 16, and FIG. 18 to FIG. 20, the ceiling plate 31 is formed in a disc shape having a smaller diameter than that of the case 2 and provided to cover an upper outer edge in an outer edge of the detection space 34. In addition, since an upper surface of the ceiling plate 31 has an arrow 31*a* along a direction in which a light emitting unit 52 and a light receiving unit 53 described below are arranged in parallel, the arrow 31*a* can be used when the alarm apparatus 100 is assembled. The labyrinth 32 is used to inhibit ambient light from entering the detection space 34. As illustrated in FIG. 14, FIG. 15, and FIG. 17 to FIG. 20, the labyrinth 32 is provided to cover an outer edge substantially along the height direction (Z direction) in the outer edge of the detection space 34 below the ceiling plate 31. The insect screen 33 is an insect repellent section that prevents insects, etc. from entering the detection space 34 while allowing outside air to enter the detection space 34 through small holes of the insect screen 33. The insect screen 33 is formed in an annular shape surrounding an outer periphery of the labyrinth 32 (specifically, an outer periphery of an outer labyrinth 37 described below), and has a large number of small holes having sizes at which insects are difficult to intrude on a side surface thereof. Incidentally, details of the configuration of the detector cover 3 will be described below.

(Configuration—Detector Body)

Next, FIG. 21 is a bottom view of the detector body, FIG. 22 is a plan view of the detector body, and FIG. 23 is a front view of the detector body. As illustrated in FIG. 4, the detector body 4 of these respective drawings is an arranging section that arranges the detector cover 3 and a second light shielding section that inhibits ambient light from entering the detection space 34. Specifically, the detector body 4 forms a flow path of gas between the back case 21 and the detector body 4 after shielding gas flowing into the case 2 from the outer inflow opening 23 so that the gas does not enter between the detector body 4 and the front case 22. For example, the detector body 4 spreads from the detector cover 3 side of FIG. 4 to the outer inflow opening 23 side in the direction along the XY plane, has a diameter larger than that of the ceiling plate 31 of the detector cover 3 and slightly smaller than that of the front case 22 as illustrated in FIG. 6, and has a disc shape, a part of which is cut out. Further, the detector body 4 has a shape in which a part on the inner side bulges from the lower side (−Z direction) toward the upper side (+Z direction), and is integrally formed as a whole and made of resin. Incidentally, the statement "diameter slightly smaller than that of the front case 22" means that the diameter of the detector body 4 is a "diameter" at which a detector body-side end portion 400*a* comes into contact with (or approaches) a front case-side end portion 222*a* from the inner side as illustrated in FIG. 4. Incidentally, the "detector body-side end portion" 400*a* is an outer edge of the detector body 4 and an edge on the outer inflow opening 23 side.

More specifically, the detector body 4 of FIG. 6 includes a flange portion 41, an inclined portion 42, a bulging portion 43, a detector body notch portion 44, a speaker accommodation portion 45, and an element cover 46 of FIG. 21 to FIG. 23. The flange portion 41 is a portion that spreads in the direction along the XY plane on the outer side in the detector body 4, and includes a positioning recess 411. The positioning recess 411 is a positioning section for positioning the rib 65 of the back case 21 with respect to the detector body 4. Specifically, a plurality of positioning recesses 411 is provided on an outer edge portion of the flange portion 41 and recessed from the upper side (+Z side) to the lower side (−Z side). In addition, the inclined portion 42 is a part continuous from the flange portion 41, and is a part inclined toward the upper side (+Z direction) with respect to the flange portion 41 (direction along the XY plane) to provide the detection space 34 of FIG. 4 above (+Z direction) the outer inflow opening 23. In addition, the bulging portion 43 is a part on which the detector cover 3 is provided and a part which is located on the upper side (+Z direction) of the flange portion 41, is continuous from the inclined portion 42, and spreads in the direction along the XY plane. An arrangement recess 431 of FIG. 6 is formed on a surface of the bulging portion 43 on the upper side (+Z direction). The arrangement recess 431 is a part in which the detector cover 3 is arranged, specifically is a circular recess, and is a recess having a diameter corresponding to an outer diameter of the detector cover 3. In addition, the detector body notch portion 44 is a part cut out in a shape corresponding to an outer shape of the component case 616 to provide a component case 616 described below to the alarm apparatus 100. In addition, the speaker accommodation portion 45 is a part bulging from the lower side (−Z direction) to the upper side (+Z direction) to correspond to an outer shape of an accommodated speaker in order to accommodate a speaker (not illustrated) (a sound output section that outputs alarm information as sound) between the detector body 4 and the front case 22. In addition, the element cover 46 covers the light emitting unit 52 and the light receiving unit 53 described below in the circuit unit 5 from the upper side (+Z direction) to prevent accumulation of dust on the light emitting unit 52 and the light receiving unit 53, is formed in the arrangement recess 431 in the bulging portion 43, and has an optical path hole for forming an optical path between the light emitting unit 52 and the light receiving unit 53 described below in the circuit unit 5 and the detection space 34 of FIG. 4. In addition, with regard to this optical path, in the embodiment, a shape and an installation position of each part are set so that detection light irradiated from the light emitting unit 52 described below is directly incident on an inner labyrinth 36 described below without being directly received by the light receiving unit 53.

(Configuration—Circuit Unit)

Next, FIG. 24 is a bottom view of the circuit unit, FIG. 25 is a plan view of the circuit unit, and FIG. 26 is a front view of the circuit unit. The circuit unit 5 of these respective drawings is a circuit section that forms an electric circuit for issuing a warning, and more specifically includes a circuit board 51, the light emitting unit 52, the light receiving unit 53, a shield 54, the switch 55, a power supply connector CN1, and a control unit (not illustrated). The circuit board 51 is a mounting section on which each element of the alarm apparatus 100 is mounted. Specifically, a through-hole and a terminal surrounding the through-hole are provided at predetermined positions so that each element is mounted on a mounting surface on the upper side (+Z direction) (hereinafter an upper mounting surface) or a mounting surface on the lower side (−Z direction) (hereinafter, a lower mounting surface) using solder, etc. The light emitting unit 52 is a light emitting section that detects smoke by irradiating detection light toward the detection space 34. Specifically, as illustrated in FIG. 4, the light emitting unit 52 is an element mounted on the upper mounting surface of the circuit board 51 to be able to emit light toward the detection space 34 provided on the upper side (+Z direction) of the light emitting unit 52, and is, for example, a light emitting diode. The light receiving unit 53 is a light receiving section that receives scattered light generated when detection light irradiated from the light emitting unit 52 is scattered by particles of smoke flowing into the detection space 34. Specifically, the light receiving unit 53 is an element mounted on the upper mounting surface of the circuit board 51 to be able to receive light from the detection space 34 provided on the upper side (+Z direction) of the light receiving unit 53, and is, for example, a photodiode. The shield 54 of FIG. 26 is a shielding section for electromagnetically shielding the light receiving unit 53, is a support section that supports the light receiving unit 53 with respect to the circuit board 51, specifically is a conductive element mounted on the upper mounting surface of the circuit board 51, and is formed of, for example, a metal. The switch 55 of FIG. 24 is an operation section for operating the alarm apparatus 100, specifically is an element mounted on the lower mounting surface of the circuit board 51, and is, for example, a push switch. The power supply connector CN1 of FIG. 25 is a supply section for supplying a power supply voltage to the alarm apparatus 100, specifically is used to supply a power supply voltage from a battery (not illustrated) as a power supply, and is mounted on the upper mounting surface of the circuit board 51. The control unit controls each operation of the alarm apparatus, and specifically is mounted on the upper mounting surface (or the lower mounting surface) of the circuit board 51. In such a circuit unit 5, the control unit determines that a fire has broken out in the monitored area when the amount of light received by the light receiving unit 53 exceeds a predetermined threshold.

(Configuration—Details of Configuration of Detector Cover)

Next, details of the configuration of the detector cover 3 will be described. Schemes described below are applied to configurations of the ceiling plate 31 and the labyrinth 32 of the detector cover 3.

(Configuration—Details of Configuration of Detector Cover—Ceiling Plate)

First, the configuration of the ceiling plate 31 of the detector cover 3 will be described. As illustrated in FIG. 15, FIG. 17, and FIG. 19, a light trap 35 is formed on a side surface of the ceiling plate 31 on the detection space 34 side (a lower surface of the ceiling plate 31 illustrated in FIG. 15). The light trap 35 diffusely reflects light directly or indirectly incident from the light emitting unit 52. As illustrated in FIG. 15, FIG. 17, and FIG. 19, the light trap 35 is formed in a portion corresponding to the detection space 34 on the lower surface of the ceiling plate 31, and specifically is formed so that a portion corresponding to the detection space 34 has a convex-concave shape continuous along the direction in which the light emitting unit 52 and the light receiving unit 53 are arranged in parallel. In this way, since detection light entering from the light emitting unit 52 can be diffusely reflected by the light trap 35, detection light can be attenuated and reflected when compared to a case in which the light trap 35 is not formed on the ceiling plate 31 and incident detection light is reflected without change by the ceiling plate 31 without being diffusely reflected. Therefore, even when the light receiving unit 53 directly receives detection light reflected by the light trap 35, it is possible to maintain detection accuracy of smoke by the alarm apparatus 100.

(Configuration—Details of Configuration of Detector Cover—Labyrinth)

Next, a description will be given of the configuration of and the labyrinth 32 of the detector cover 3. FIG. 27 is a plan view illustrating a state in which the detector cover (insect screen is not illustrated) is attached to the detector body, and FIG. 28 is a side view illustrating the state in which the detector cover (insect screen is not illustrated) is attached to the detector body. FIG. 29 is a cross-sectional view taken along D-D line of FIG. 27, and FIG. 30 is an enlarged view of a part around an area E of FIG. 29. As illustrated in FIG. 15, FIG. 17, FIG. 19, FIG. 20, FIG. 29, and FIG. 30, the labyrinth 32 includes the inner labyrinth 36 and the outer labyrinth 37.

(Configuration—Details of Configuration of Detector Cover—Labyrinth—Inner Labyrinth)

The inner labyrinth 36 is a first light shielding section that covers the outer edge substantially along the height direction (Z direction) among the outer edge of the detection space 34. As illustrated in FIG. 15 and FIG. 17, the inner labyrinth 36 is formed of a rectangular ring (specifically, a square ring), and specifically includes a first side piece 36*a* and a second side piece 36*b* located on the light emitting unit 52 side (right side of FIG. 17) and a third side piece 36*c* and a fourth side piece 36*d* located on the light receiving unit 53 side (left side of FIG. 17) (more specifically, each of the side pieces is formed of a smooth plate-shaped body). The first side piece 36*a* is connected to the second side piece 36*b* and the third side piece 36*c*, and the fourth side piece 36*d* is connected to the second side piece 36*b* and the third side piece 36*c* (incidentally, the first side piece 36*a*, the second side piece 36*b*, the third side piece 36*c*, and the fourth side piece 36*d* are simply collectively referred to as a "side piece 36*e*" when it is unnecessary to particularly distinguish the side pieces). Further, the inner labyrinth 36 is provided such that one of end portions on an open side in the inner labyrinth 36 (an upper end portion of the inner labyrinth 36 illustrated in FIG. 19) comes into contact with the ceiling plate 31.

In addition, as illustrated in FIG. 15, FIG. 19, and FIG. 20, the inner labyrinth 36 has a first inner inflow opening 36*f* The first inner inflow opening 36*f* is a first opening for allowing gas to flow into the detection space 34. As illustrated in FIG. 15, FIG. 19, and FIG. 20, the first inner inflow opening 36*f* is an opening at an open side end portion in the inner labyrinth 36 (lower end portion of the inner labyrinth 36 illustrated in FIG. 19) and is formed such that a planar shape corresponds to a rectangular shape.

Here, a size and an installation position of the first inner inflow opening 36*f* are arbitrary. In the embodiment, the size and the installation position are set so that gas can flow into a center of the detection space 34. Specifically, as illustrated in FIG. 15, FIG. 17, FIG. 19, and FIG. 20, the size of the first inner inflow opening 36*f* is set to a size slightly smaller than an outer shape of the lower end portion of the inner labyrinth 36. In addition, as illustrated in FIG. 15, FIG. 17, FIG. 19, and FIG. 20, the installation position of the first inner inflow opening 36*f* is set to a position at which a center point of the first inner inflow opening 36*f* coincides with a center of the detection space 34 in an imaginary XY plane. In addition, as for installation positions of the first inner inflow opening 36*f* and the detector body 4, in the embodiment, the detector body 4 is disposed at a position at which ambient light can be prevented from directly entering the detection space 34 through the first inner inflow opening 36*f* Specifically, as illustrated in FIG. 30, the detector body 4 is disposed at a position that faces the first inner inflow opening 36*f* and is separated from the first inner inflow opening 36*f* by a first gap 38. More specifically, the detector body 4 is disposed such that the bulging portion 43 of the detector body 4 is positioned immediately below the first inner inflow opening 36*f* with the first gap 38 therebetween. Incidentally, in the embodiment, a height of the first gap 38 is set to a length that allows a desired amount of gas to flow into the detection space 34 via the first inner inflow opening 36*f* Specifically, the height may differ depending on the shapes of the inner labyrinth 36, the first inner inflow opening 36*f*, and the detector body 4, and thus is set on the basis of an experimental result, etc. Incidentally, details of the configuration of the inner labyrinth 36 will be described below.

(Configuration—Details of Configuration of Detector Cover—Labyrinth—Outer Labyrinth)

In addition, the outer labyrinth 37 is a third light shielding section that covers the first gap 38. As illustrated in FIG. 14, FIG. 15, FIG. 17 to FIG. 20, and FIG. 28 to FIG. 30, the outer labyrinth 37 is formed in an annular body that allows the inner labyrinth 36 to be inscribed in the outer labyrinth 37, and provided such that one of open side end portions of the outer labyrinth 37 (upper end portion of the outer labyrinth 37 illustrated in FIG. 19) comes into contact with the ceiling plate 31.

Here, specific configurations of the inner labyrinth 36 and the outer labyrinth 37 have the following features in the embodiment.

First, as a feature related to the gas inflow ability, the outer labyrinth 37 is disposed at a position at which gas outside the detector cover 3 can be inhibited from flowing into the detection space 34 through the first gap 38 and the first inner inflow opening 36*f* in order without striking the inner labyrinth 36. Specifically, as illustrated in FIG. 19, the outer labyrinth 37 is disposed at a position separated from the first gap 38 by a second gap 39 on an imaginary line HL which is orthogonal to a direction (Z direction) in which the first inner inflow opening 36*f* and the detector body 4 face each other (that is, imaginary line HL along the horizontal direction) and passes through the first gap 38. More specifically, the outer labyrinth 37 is disposed at a horizontally outer position separated from the inner labyrinth 36 by the second gap 39 and a position at which the entire first gap 38 is covered by the outer labyrinth 37. Incidentally, in the embodiment, a width of the second gap 39 is set to a length that allows a desired amount of gas to flow into the first gap 38 while the outer labyrinth 37 is made compact. Specifically, the width may differ depending on the shapes of the inner labyrinth 36 and the outer labyrinth 37, and thus is set on the basis of an experimental result, etc. According to such a configuration, when gas outside the detector cover 3 flows into the second gap 39 through a second inner inflow opening 37*a* described below, the gas outside the detector cover 3 can be allowed to flow into the first gap 38 after striking the inner labyrinth 36, and thus it is possible to inhibit inflow of dust into the detection space 34.

In addition, as a feature related to the light shielding ability, the outer labyrinth 37 is disposed at a position at which ambient light can be inhibited from entering the detection space 34 by the inner labyrinth 36 and the outer labyrinth 37. Specifically, as illustrated in FIG. 19, similarly to the feature related to the gas inflow ability, the outer labyrinth 37 is disposed at a horizontally outer position separated from the inner labyrinth 36 by the second gap 39 and a position at which the entire first gap 38 is covered by the outer labyrinth 37. According to such a configuration, even when light outside the detector cover 3 attempts to enter the detection space 34, this outside light can be blocked by the inner labyrinth 36 or the outer labyrinth 37, and thus ambient light can be inhibited from entering the detection space 34.

In addition, as a feature for further improving the gas inflow ability and the light shielding ability described above, as illustrated in FIG. 19, FIG. 29, and FIG. 30, the inner labyrinth 36 and the outer labyrinth 37 are formed so that the inner labyrinth 36 and the outer labyrinth 37 overlap each other along a direction (horizontal direction) orthogonal to a direction (Z direction) in which the inner inflow opening 36*f* and the detector body 4 face each other. Specifically, the inner labyrinth 36 and the outer labyrinth 37 are formed so that an entire portion of the outer labyrinth 37 other than a portion facing the first gap 38 overlaps the inner labyrinth 36. According to such a configuration, in a case in which gas outside the detector cover 3 flows into the second gap 39 through the second inner inflow opening 37*a* described below, the gas can reliably strike the inner labyrinth 36 when compared to a case in which the inner labyrinth 36 and the outer labyrinth 37 are not formed to overlap each other, and thus it is possible to further inhibit dust from flowing into the detection space 34. In addition, even when light outside the detector cover 3 attempts to enter the detection space 34, the outside light can be reliably shielded by the inner labyrinth 36 or the outer labyrinth 37 when compared to a case in which the inner labyrinth 36 and the outer labyrinth 37 are not formed to overlap each other, and thus it is possible to further inhibit ambient light from entering the detection space 34.

Furthermore, as a feature for increasing the amount of gas flowing into the detection space 34, as illustrated in FIG. 14, FIG. 15, FIG. 18, FIG. 19, and FIG. 28 to FIG. 30, a plurality of second inner inflow openings 37*a* is formed in a portion in which the inner labyrinth 36 and the outer labyrinth 37 overlap each other (more specifically, a portion of the outer labyrinth 37 overlapping the inner labyrinth 36). Here, the second inner inflow opening 37*a* is a second opening for allowing gas outside the detector cover 3 to flow into the second gap 39. A shape of the second inner inflow opening 37*a* is arbitrary. In the embodiment, the shape is set to a shape that allows strength of the outer labyrinth 37 to be ensured. Specifically, as illustrated in FIG. 14, FIG. 15, FIG. 18, and FIG. 19, a width of the second inner inflow opening 37*a* is set to be shorter than a width of each side piece 36*e* of the inner labyrinth 36, and a height of the second inner inflow opening 37*a* is set to be substantially the same as or lower than a height of the portion of the outer labyrinth 37 overlapping the inner labyrinth 36. In addition, an installation position of the second inner inflow opening 37*a* is arbitrary. In the embodiment, the installation position is set to a position at which gas from the horizontal direction can flow into the second gap 39. Specifically, as illustrated in FIG. 15, FIG. 19, and FIG. 30, the installation position is set to a portion facing each side piece 36*e* of the inner labyrinth 36 in the portion of the outer labyrinth 37 overlapping the inner labyrinth 36 (more specifically, two second inner inflow openings 37*a* are provided in the portion facing each side piece 36*e* of the inner labyrinth 36). According to such a configuration, gas outside the detector cover 3 can be allowed to flow into the detection space 34 through the second inner inflow opening 37*a*, the second gap 39, the first gap 38, and the first inner inflow opening 36*f* in order. In particular, since the shape of the second inner inflow opening 37*a* can be set according to a shape of the portion of the outer labyrinth 37 overlapping the inner labyrinth 36, it is possible to increase the amount of gas flowing into the detection space 34.

In addition, a method of forming the detector cover 3 configured in this way is arbitrary. In the embodiment, the detector cover 3 is formed such that a structure of the detector body 4 is simplified. Specifically, as illustrated in FIG. 19, FIG. 29, and FIG. 30, the ceiling plate 31, the inner labyrinth 36, and the outer labyrinth 37 are integrally formed with each other, and the detector body 4 is separately formed from the inner labyrinth 36, the outer labyrinth 37, and the ceiling plate 31. In this case, a connection method between the detector cover 3 and the detector body 4 is arbitrary. In the embodiment, it is desirable to adopt a method that allows connection without using a connection member such as a screw. Specifically, by inserting a fitting piece 37*b* illustrated in FIG. 18 formed on a lower end portion of the outer labyrinth 37 into a fitting hole (not illustrated) formed in the bulging portion 43 of the detector body 4, the detector cover 3 is detachably connected to the detector body 4. According to such a formation method, when compared to a case in which the detector body 4 and the inner labyrinth 36 (or the outer labyrinth 37) are integrally formed with each other, it is possible to simplify the structure of the detector body 4, and to improve manufacturability of the detector body 4.

A design parameter for determining the light shielding ability (for example, installation angles, heights, etc. of the inner labyrinth 36 and the outer labyrinth 37) and a design parameter for determining the gas inflow ability (for example, the height of the first gap 38, the width of the second gap 39, etc.) can be separated from each other by the detector cover 3 described above. Thus, a degree of freedom in design of the detector cover 3 can be improved when compared to a conventional technology.

(Configuration—Action of Detector Cover) Next, an action of the detector cover 3 configured as described above will be described. The action of the detector cover 3 is roughly divided into an action of causing gas to flow into the detection space 34 (hereinafter referred to as a "gas inflow action") and an action of inhibiting ambient light from entering the detection space 34 (light shielding action).

(Configuration—Action of Detector Cover—Gas Inflow Action)

First, the gas inflow action will be described. FIG. 31 is a diagram illustrating a flow of gas in FIG. 30. Incidentally, an arrow F of FIG. 31 indicates a direction in which gas containing smoke flows based on a result of a predetermined experiment or simulation. In addition, the alarm apparatus 100 can guide gas moving along the installation surface 900 from every direction outside the case 2 to the inside of the alarm apparatus 100 and further to the detection space 34. Here, for example, a description will be given of a case in which gas guided to the inside of the alarm apparatus 100 is guided to the detection space 34 along the arrow F of FIG. 31.

As illustrated in FIG. 31, first, gas outside the detector cover 3 guided to the inside of the alarm apparatus 100 flows into the second gap 39 through the second inner inflow opening 37*a* located on the left side of FIG. 31. Subsequently, when gas flowing into the second gap 39 strikes the inner labyrinth 36, a flow direction of the gas is changed from the horizontal direction to a downward direction. In this way, the gas is guided to the lower side along the second gap 39. In this case, since at least a part of dust contained in the gas flowing into the second gap 39 is dropped downward by striking the inner labyrinth 36 and stays in a lower end portion of the second gap 39, it is possible to inhibit the dust from flowing into the detection space 34. Subsequently, the gas guided to the lower side moves through the second gap 39 substantially along the downward direction, and then flows into the first gap 38. Subsequently, the gas flowing into the first gap 38 moves through the first gap 38 substantially along the horizontal direction, and then the gas flows into the detection space 34 through the first inner inflow opening 36*f* Subsequently, the gas flowing into the detection space 34 moves inside the detection space 34, and then the gas flows out to the first gap 38 through the first inner inflow opening 36*f* Subsequently, the gas flowing out to the first gap 38 moves through the first gap 38 substantially along the horizontal direction, and then the gas is guided to the upper side along the second gap 39 by the gas striking the outer labyrinth 37 so that a flow direction of the gas changes from the horizontal direction to an upward direction. Subsequently, the gas guided to the upper side moves through the second gap 39 substantially along the upward direction, and then the gas flows out to the outside of the outer labyrinth 37 through the second inner inflow opening 37*a* located on the right side of FIG. 31.

By such an action, the gas outside the detector cover 3 can be reliably guided to the detection space 34 through the first inner inflow opening 36*f*, the first gap 38, the second gap 39, and the second inner inflow opening 37*a* in order, and smoke can be detected by the alarm apparatus 100. In addition, when the gas flowing into the second gap 39 strikes the inner labyrinth 36, dust contained in the gas can be shaken off, and thus an inflow of dust into the detection space 34 can be inhibited.

(Configuration—Action of Detector Cover—Light Shielding Action)

Next, the light shielding action will be described. Light outside the detector cover 3 entering the inside of the alarm apparatus 100 is inhibited from entering the detection space 34 by the detector cover 3 and the detector body 4 provided to cover the detection space 34. In particular, since the first gap 38 is covered by the outer labyrinth 37 provided in the detector cover 3, the outside light is inhibited from entering the detection space 34 through the first gap 38 and the first inner inflow opening 36*f* in order. In addition, even though the second inner inflow opening 37*a* is provided in the outer labyrinth 37, the second inner inflow opening 37*a* is provided in the portion of the outer labyrinth 37 overlapping the inner labyrinth 36. Thus, even when the outside light enters the second gap 39 through the second inner inflow opening 37*a*, the outside light can be reflected toward the outer side of the detector cover 3 after being made incident on the inner labyrinth 36. Therefore, the outside light can be inhibited from entering the detection space 34.

(Configuration—Details of Configuration of Inner Labyrinth)

Next, a description will be given of details of the configuration of the inner labyrinth 36 in the detector cover 3. FIG. 32 is a cross-sectional view taken along F-F line of FIG. 28, and FIG. 33 is an enlarged view of a part around an area G of FIG. 32 (the outer labyrinth 37 is not illustrated). FIG. 34 is a diagram illustrating internal reflection of detection light in the detection space 34 in FIG. 33, and FIG. 35 is a cross-sectional view taken along H-H line of FIG. 27, and is another diagram illustrating internal reflection of detection light. A scheme shown below is applied to the configuration of the inner labyrinth 36 (mainly, the shape of the inner labyrinth 36).

In the embodiment, at least a part of a side surface of the inner labyrinth 36 on the detection space 34 side is formed in a flat shape which can inhibit detection light reflected by the inner labyrinth 36 from entering a field of view RV of the light receiving unit 53 in the detection space 34 (a dotted line part illustrated in FIG. 34 and FIG. 35, hereinafter, simply referred to as a "field of view RV"). Here, the "field of view RV" refers to a portion corresponding to a range of view in which light can be received by the light receiving unit 53 in a portion of the detection space 34. Incidentally, in the embodiment, as illustrated in FIG. 34, detection light irradiated from the light emitting unit 52 is described as having a predetermined width, which widens as a distance from the light emitting unit 52 increases.

Specifically, a flat shape portion of the inner labyrinth 36 includes a portion 71 (hereinafter referred to as a "first incident portion 71"), on which detection light is directly incident from the light emitting unit 52, in the inner labyrinth 36 and a portion 72 (hereinafter referred to as a "second incident portion 72"), on which detection light is directly incident from the first incident portion 71, in the inner labyrinth 36. In these portions, a vicinity of any one of four corners of the inner labyrinth 36 is formed as the first incident portion 71. More specifically, as illustrated in FIG. 32 and FIG. 33, a vicinity of a corner 81 (hereinafter referred to as a "first corner 81") formed by the third side piece 36*c* and the fourth side piece 36*d* in the inner labyrinth 36 (that is, a portion of each of the third side piece 36*c* and the fourth side piece 36*d* on the first corner 81 side) is formed as the first incident portion 71. In addition, a vicinity of a corner not facing a corner on the first incident portion 71 side among the four corners in the inner labyrinth 36 is formed as the second incident portion 72. More specifically, as illustrated in FIG. 32 and FIG. 33, each of a vicinity of a corner 82 (hereinafter referred to as a "second corner 82") formed by the first side piece 36*a* and the third side piece 36*c* (that is, a portion of the third side piece 36*c* on the second corner 82 side) and a vicinity of a corner 83 (hereinafter referred to as a "third corner 83") formed by the second side piece 36*b* and the fourth side piece 36*d* (that is, a portion of the fourth side piece 36*d* on the third corner 83 side) is formed as the second incident portion 72.

In addition, installation positions of the inner labyrinth 36 and the light emitting unit 52 (or an optical path hole of the element cover 46 on the light emitting unit 52 side) are arbitrary. In the embodiment, the inner labyrinth 36 and the light emitting unit 52 are installed at positions shown below. That is, first, the inner labyrinth 36 and the light emitting unit 52 (or the optical path hole of the element cover 46 on the light emitting unit 52 side) are disposed such that detection light directly incident on the first incident portion 71 from the light emitting unit 52 is reflected toward the second incident portion 72. Specifically, as illustrated in FIG. 33 and FIG. 34, the inner labyrinth 36 and the light emitting unit 52 (or the optical path hole of the element cover 46 on the light emitting unit 52 side) are disposed such that when detection light irradiated from the light emitting unit 52 is directly incident on a portion of the third side piece 36*c* on the first corner 81 side corresponding to the first incident portion 71 (for example, an incident point P1 of FIG. 34 described below, etc.), the incident detection light is reflected toward a portion of the fourth side piece 36*d* on the third corner 83 side corresponding to the second incident portion 72 (for example, an incident point P2 of FIG. 34 described below, etc.). In addition, the inner labyrinth 36 and the light emitting unit 52 (or the optical path hole of the element cover 46 on the light emitting unit 52 side) are disposed at positions that allow detection light directly irradiated from the light emitting unit 52 to be evenly incident on the first incident portion 71 of each of the third side piece 36*c* and the fourth side piece 36*d*. Specifically, as illustrated in FIG. 33, the inner labyrinth 36 and the light emitting unit 52 (or the optical path hole of the element cover 46 on the light emitting unit 52 side) are disposed at positions at which a bisector BL that bisects an angle of the first corner 81 overlaps the light emitting unit 52 (or the optical path hole of the element cover 46 on the light emitting unit 52 side) on the imaginary XY plane.

According to such a configuration, when compared to a conventional technology, it is possible to inhibit detection light from entering the field of view RV. Therefore, it is possible to inhibit scattered light (detection light) scattered by particles of smoke present in the field of view RV from being received by the light receiving unit 53, and thus it is possible to maintain detection accuracy of smoke by the alarm apparatus 100. In addition, even when the entire inner labyrinth 36 is formed in a shape of a rectangular ring, incidence of detection light on the field of view RV can be avoided until detection light is reflected at least twice or more by the first incident portion 71 and the second incident portion 72, and thus it is possible to further maintain detection accuracy of smoke by the alarm apparatus 100.

(Configuration—Action of Inner Labyrinth)

Next, a description will be given of an action of the inner labyrinth 36 configured as described above. Here, an arrow L of FIG. 34 and FIG. 35 illustrates a direction in which detection light travels based on a result of a predetermined simulation.

First, detection light irradiated from the light emitting unit 52 is directly incident on the entire first incident portion 71 of the inner labyrinth 36. However, in the incident detection light, detection light directly incident on a portion of the third side piece 36*c* on the first corner 81 side corresponding to the first incident portion 71 (hereinafter referred to as an "incident point P1") is internally reflected as described below. Specifically, as illustrated in FIG. 34 and FIG. 35, first, detection light incident on the incident point P1 is reflected toward the fourth side piece 36*d* side. Subsequently, the detection light reflected toward the fourth side piece 36*d* side enters a portion of the fourth side piece 36*d* on the third corner 83 side corresponding to the second incident portion 72 (hereinafter referred to as an "incident point P2") without entering the field of view RV, and then is reflected toward the ceiling plate 31 side. Subsequently, the detection light reflected toward the ceiling plate 31 side enters a vicinity P3 of the incident point P2 of the ceiling plate 31 (hereinafter referred to as an "incident point P3") without entering the field of view RV, and then is reflected toward the second side piece 36*b* side. Subsequently, the detection light reflected toward the second side piece 36*b* side enters a portion P4 of the second side piece 36*b* on the third corner 83 side (hereinafter referred to as an "incident point P4") without entering the field of view RV, and then is reflected toward the third side piece 36*c* side. Subsequently, the detection light reflected toward the third side piece 36*c* side enters a portion P5 of the third side piece 36*c* on the second corner 82 side (hereinafter referred to as an "incident point P5") without entering the field of view RV.

As described above, when detection light irradiated from the light emitting unit 52 is directly incident on the first incident portion 71, the detection light can be repeatedly reflected a plurality of times without the detection light entering the field of view RV. Thus, the detection light can be effectively attenuated. Therefore, even when the light receiving unit 53 receives the detection light repeatedly reflected, the amount of light received by the light receiving unit 53 can be prevented from becoming an excessive amount, and thus it is possible to maintain the detection accuracy of smoke by the alarm apparatus 100.

(Assembly Method)

Next, a method of assembling the alarm apparatus 100 will be described. First, in FIG. 6, each element is mounted on the circuit board 51 of the circuit unit 5. Specifically, in a state in which the circuit board 51 is disposed and fixed to a predetermined jig, each element is mounted using, for example, a solder, etc.

Subsequently, the detector cover 3 is disposed on the detector body 4. Specifically, the detector cover 3 is press-fit to and disposed in the arrangement recess 431.

Subsequently, the push button 223 and the circuit board 51 are disposed on the front case 22, and the detector body 4 on which the detector cover 3 is disposed is further disposed on the front case 22. Specifically, with regard to arrangement of the detector body 4, the light emitting unit 52 and the light receiving unit 53 of the circuit board 51 are appropriately covered by the element cover 46 of the detector body 4, and the positioning recess 411 of the detector body 4 is supported (placed) on the support 225 of the front case 2.

Subsequently, the back case 21 is disposed on the front case 22. Specifically, the component cases 613 and 614 of the back case 21 of FIG. 5 face and come into contact with the screw boss 224 of the front case 22 of FIG. 6 through a through-hole 47 of the detector body 4, and the rib 65 of the back case 21 is provided in the positioning recess 411 of the detector body 4.

Subsequently, the back case 21 is fixed to the front case 22. Specifically, fixing screws 613*a* and 614*a* are inserted into insertion holes 613*b* and 614*b* communicating with the component cases 613 and 614 of the back case 21, and the component cases 613 and 614 of FIG. 5 and the screw boss 224 of FIG. 6 are screwed together and fixed to each other using the inserted fixing screws 613*a* and 614*a*. In this case, the positioning recess 411 of the detector body 4 is interposed and fixed by the support 225 of the front case 2 and the rib 65 of the back case 21, and the outer inflow opening 23 is formed as illustrated in FIG. 3. In this way, assembly of the alarm apparatus 100 is completed.

(Installation Method)

Next, a method of installing the alarm apparatus 100 will be described. First, the attachment base 1 is attached to the installation surface 900 of FIG. 4. Specifically, the attachment base 1 is attached by screwing the attachment screw to the installation surface 900 through the screw hole 121 of FIG. 6 in a state where the installation surface-side facing surface 12B faces the installation surface 900.

Subsequently, the case 2 of the alarm apparatus 100 of FIG. 4 assembled by the above-described "assembly method" is attached to the attachment base 1. Specifically, the case 2 is attached by engaging the engagement portion 214 of the back case 21 of FIG. 6 with the engagement portion 122 of the attachment base 1 of FIG. 5. In this way, installation of the alarm apparatus 100 is completed.

Effect of Embodiment

As described above, according to the present embodiment, since the light shielding section includes the inner labyrinth 36 that covers the outer edge of the detection space 34 and has the first inner inflow opening 36*f*, the detector body 4 disposed at a position that faces the first inner inflow opening 36*f* and is separated from the first inner inflow opening 36*f* by the first gap 38, and the outer labyrinth 37 disposed at a position separated from the first gap 38 by the second gap 39 on the imaginary line that is orthogonal to the direction in which the first inner inflow opening 36*f* and the detector body 4 face each other and passes through the first gap 38, and gas outside the detector cover 3 is allowed to flow into the detection space 34 through the second gap 39, the first gap 38, and the first inner inflow opening 36*f* in order, the design parameter for determining the light shielding ability of the detector cover 3 (for example, the installation angle, the height, etc. of the inner labyrinth 36 or the outer labyrinth 37) and the design parameter for determining the gas inflow ability of the detector cover 3 (for example, the height of the first gap 38, the width of the second gap 39, etc.) can be separated from each other, and a degree of freedom in design of the detector cover 3 can be improved when compared to a conventional technology.

In addition, since the inner labyrinth 36 and the outer labyrinth 37 are formed such that the inner labyrinth 36 and the outer labyrinth 37 overlap each other in the direction orthogonal to the direction in which the first inner inflow opening 36*f* and the detector body 4 face each other, when compared to a case in which the inner labyrinth 36 and the outer labyrinth 37 are not formed to overlap each other, it is possible to inhibit the gas from directly flowing into the first gap 38 without striking the inner labyrinth 36, and it is possible to inhibit inflow of dust into the detection space 34.

In addition, since the second inner inflow opening 37*a* which allows the gas outside the detector cover 3 to flow into the second gap 39 is formed at the portion in which the inner labyrinth 36 and the outer labyrinth 37 overlap each other, it is possible to cause the gas outside the detector cover 3 to flow into the detection space 34 through the second inner inflow opening 37*a*, the second gap 39, the first gap 38, and the first inner inflow opening 36*f* in order. In particular, the shape of the second inner inflow opening 37*a* can be set in accordance with the shape of the portion in which the inner labyrinth 36 and the outer labyrinth 37 overlap each other, and the amount of gas allowed to flow into the detection space 34 can be increased when compared to a conventional technology.

In addition, since the inner labyrinth 36 and the outer labyrinth 37 are integrally formed with each other, and the detector body 4 is formed separately from the inner labyrinth 36 and the outer labyrinth 37, when compared to a case in which the detector body 4 and the inner labyrinth 36 (or the outer labyrinth 37) are integrally formed with each other, it is possible to simplify the structure of the detector body 4, and it is possible to improve manufacturability of the detector body 4.

Modification to Embodiment

Even though the embodiment according to the invention has been described above, a specific configuration and section of the invention can be arbitrarily modified and improved within the scope of the technical idea of each invention described in the claims. Hereinafter, such a modification will be described.

With Regard to Problems to be Solved and Effects of Invention

First, the problems to be solved by the invention and the effects of the invention are not limited to the above contents, and may differ depending on the details of the implementation environment and configuration of the invention. Further, only some of the problems may be solved, or only some of the effects may be achieved.

With Regard to Dispersion and Integration

In addition, the above-described configurations are functionally conceptual, and may not be physically configured as illustrated. That is, specific forms of dispersion and integration of each part are not limited to the illustrated ones, and all or some thereof can be configured to be functionally or physically dispersed or integrated in an arbitrary unit. For example, the case 2 of the alarm apparatus 100 and the attachment base 1 may be integrally configured, and the integrally configured one may be directly attached to the installation surface of the monitored area.

(With Regard to Alarm Apparatus)

In the above embodiment, the alarm method of the alarm apparatus 100 has been described as outputting the alarm information through the speaker. However, the invention is not limited thereto. For example, a signal including the alarm information may be transmitted to another apparatus (as an example, a receiver, etc. provided in a management room, etc.) through a transmission section, etc. In this case, the speaker of the alarm apparatus 100 may be omitted.

(With Regard to Substance to be Detected)

In the embodiment, a description has been given of a case in which the "substance to be detected" is "smoke", and the "alarm apparatus" is the "fire alarm (smoke alarm)". However, the invention is not limited thereto. For example, the invention can be applied to a case in which the "substance to be detected" is, for example, a (toxic) gas such as "carbon monoxide" and the "alarm apparatus" is a "gas alarm".

(With Regard to Detector Cover)

The embodiment describes that the ceiling plate, the inner labyrinth 36, and the outer labyrinth 37 of the detector cover 3 are integrally formed with each other, and the detector body is formed separately from the inner labyrinth 36, the outer labyrinth 37, and the ceiling plate. However, the invention is not limited thereto. For example, when a manufacturing condition of the detector cover 3 is limited, the ceiling plate of the detector cover 3 may be formed separately from the inner labyrinth 36 (or the outer labyrinth 37), and the detector body and the inner labyrinth 36 (or outer labyrinth 37) may be integrally formed with each other.

Figure 36:
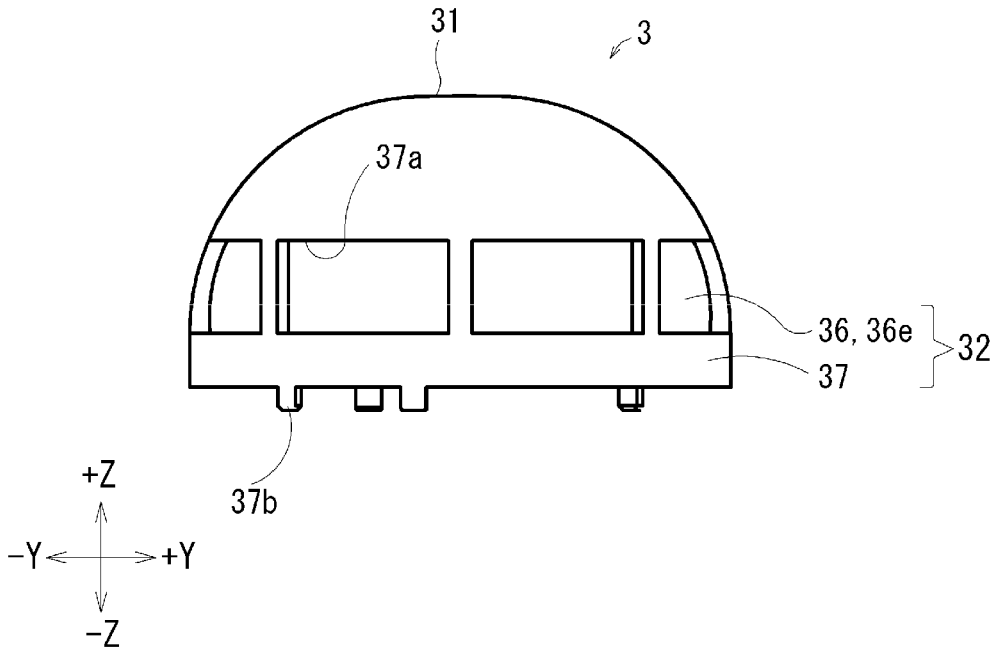
FIG. 36 is a diagram illustrating a modification of a configuration of the detector cover.

In addition, the embodiment describes that the outer shape of the detector cover 3 is formed in a cylindrical shape as illustrated in FIG. 14 and FIG. 18. However, the invention is not limited thereto. FIG. 36 is a diagram illustrating a modification of the configuration of the detector cover. For example, since it is desirable to form the shape according to user needs, the outer shape of the detector cover 3 may be formed in a hemispherical shape as illustrated in FIG. 36.

(With Regard to Inner Labyrinth)

The embodiment describes that the inner labyrinth 36 is formed of the rectangular ring. However, the invention is not limited thereto. For example, since it is desirable to form the shape according to user needs, the inner labyrinth 36 may be formed of a polygonal ring other than the rectangular ring (for example, a hexagonal ring, etc.), a circular ring, an oval ring, etc.

In addition, the embodiment describes that the installation position of the first inner inflow opening 36*f* in the inner labyrinth 36 is set to a position at which the center point of the first inner inflow opening 36*f* coincides with the center of the detection space 34 on the imaginary XY plane. However, the invention is not limited thereto. For example, when a manufacturing condition of the inner labyrinth 36 is limited, the installation position may be set to a position at which the center point of the first inner inflow opening 36*f* does not coincide with the center of the detection space 34.

(With Regard to Outer Labyrinth)

The embodiment describes that the outer labyrinth 37 is formed of a circular ring. However, the invention is not limited thereto. For example, since it is desirable to form the shape according to user needs, the outer labyrinth 37 may be formed of a polygonal ring (as an example, a hexagonal ring, etc.), an oval ring, etc.

Figure 37:
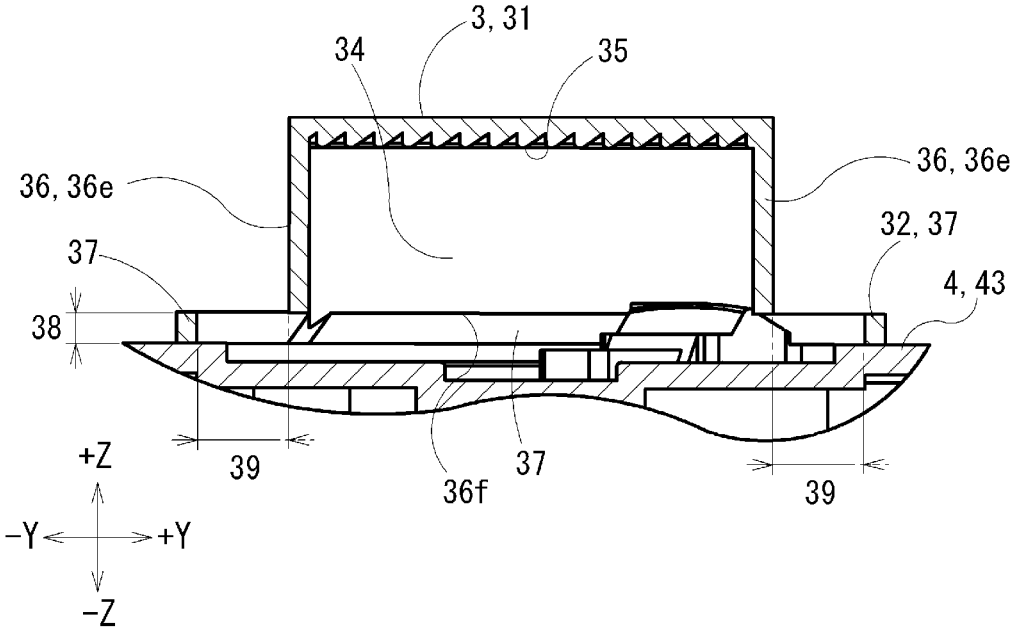
FIG. 37 is a diagram illustrating another modification of the configuration of the detector cover.

In addition, the embodiment describes that the second inner inflow opening 37*a* is formed in the outer labyrinth 37. However, the invention is not limited thereto. FIG. 37 is a diagram illustrating another modification of the configuration of the detector cover. For example, as illustrated in FIG. 37, when the detector cover 3 is formed to be able to allow gas to flow into the detection space 34 through the second gap, the first gap 38, and the first inner inflow opening 36*f* in order, the second inner inflow opening 37*a* may be omitted. Incidentally, in the detector cover 3 illustrated in FIG. 37, a connection portion (not illustrated) for connecting the inner labyrinth 36 and the outer labyrinth 37 to each other is provided between the inner labyrinth 36 and the outer labyrinth 37.

In addition, the embodiment describes that the inner labyrinth 36 and the outer labyrinth 37 are formed such that the inner labyrinth 36 and the outer labyrinth 37 overlap each other along the horizontal direction. However, the invention is not limited thereto. For example, in a case in which the desired light shielding ability and gas inflow ability can be ensured, the inner labyrinth 36 and the outer labyrinth 37 may be formed such that the inner labyrinth 36 and the outer labyrinth 37 do not overlap each other along the horizontal direction as illustrated in FIG. 37.

(With Regard to Light Shielding Section)

Figure 38A:
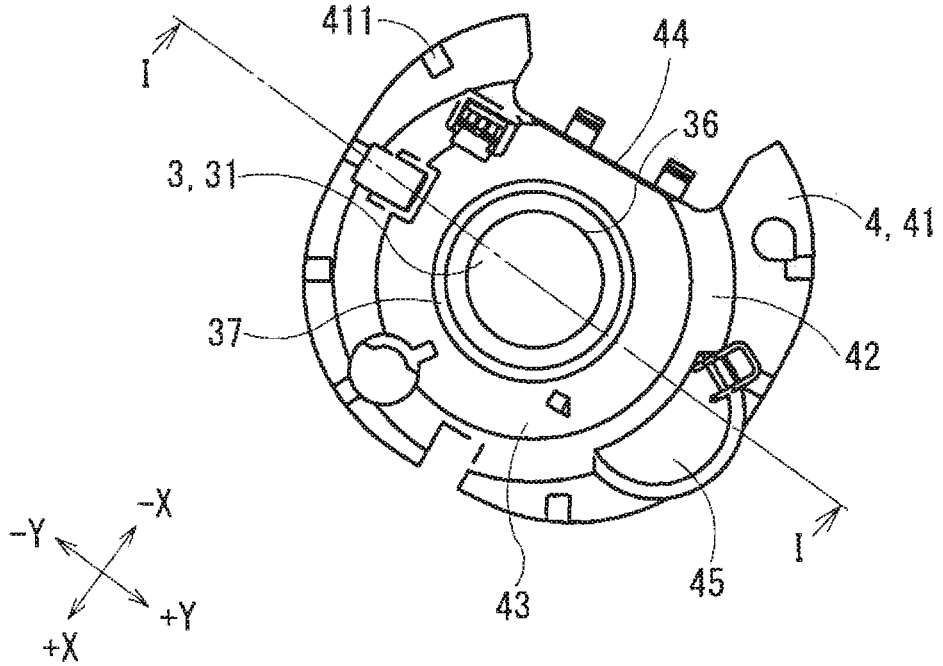
Figure 38B:
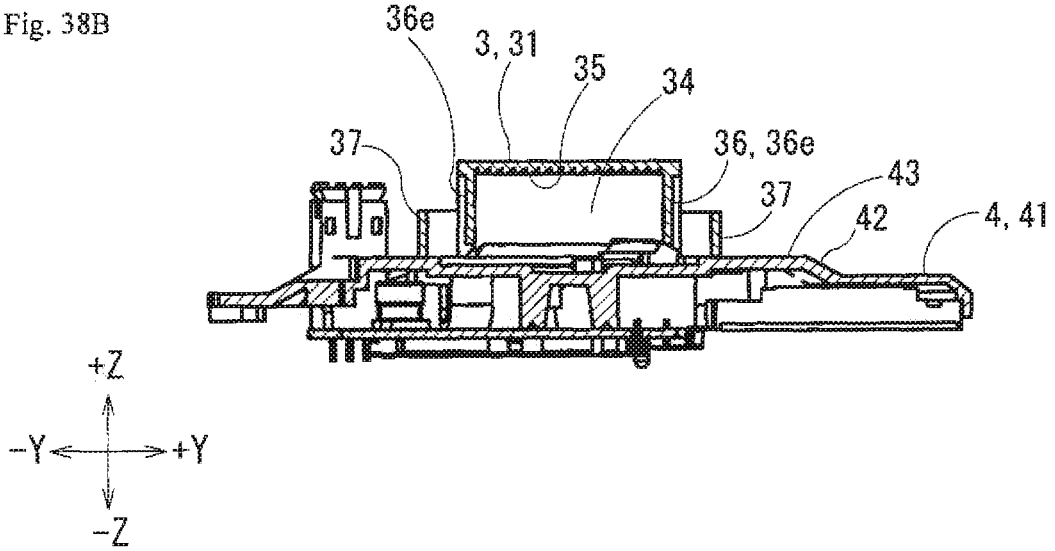

The embodiment describes that the inner labyrinth 36 (first light shielding section) and the outer labyrinth 37 (third light shielding section) are integrally formed with each other, and the detector body 4 (second light shielding section) is formed separately from the inner labyrinth 36 and the outer labyrinth 37. However, the invention is not limited thereto. FIGS. 38A and 38B are diagrams illustrating another modification of the configuration of the detector cover 3, in which FIG. 38A is a plan view and FIG. 38B is a cross-sectional view taken along I-I line of FIG. 38A. FIG. 39 is a plan view illustrating another modification of the configuration of the detector cover 3. For example, as illustrated in FIGS. 38A and 38B, the inner labyrinth 36 and the detector body 4 may be integrally formed with each other, and the outer labyrinth 37 may be formed separately from the inner labyrinth 36 and the detector body 4. In this way, when compared to a case in which the outer labyrinth 37 and the inner labyrinth 36 (or the detector body 4) are integrally formed with each other, it is possible to simplify the structure of the outer labyrinth 37, and it is possible to improve manufacturability of the outer labyrinth 37. Alternatively, the detector body 4 and the outer labyrinth 37 may be integrally formed with each other, and the inner labyrinth 36 may be formed separately from the detector body 4 and the outer labyrinth 37. In this way, when compared to a case in which the inner labyrinth 36 and the detector body 4 (or the outer labyrinth 37) are integrally formed with each other, it is possible to simplify the structure of the inner labyrinth 36, and it is possible to improve manufacturability of the inner labyrinth 36. Incidentally, even though the outer shape of the inner labyrinth 36 is formed as a cylindrical body as illustrated in FIGS. 38A and 38B, the invention is not limited thereto. For example, as illustrated in FIG. 39, the outer shape may be formed as a polygonal columnar body such as a rectangular parallelepiped.

One embodiment of the present invention provides an alarm apparatus comprising: a light shielding section for inhibiting ambient light from entering a detection space for detecting a substance to be detected contained in a gas, wherein the light shielding section includes a first light shielding section that covers an outer edge of the detection space and has a first opening, a second light shielding section disposed at a position facing the first opening, the position being separated from the first opening by a first gap, and a third light shielding section disposed at a position separated from the first gap by a second gap on an imaginary line orthogonal to a direction in which the first opening and the second light shielding section face each other, the imaginary line passing through the first gap, and the gas outside the light shielding section is allowed to flow into the detection space through the second gap, the first gap, and the first opening in order.

According to this embodiment, since the light shielding section includes the first light shielding section that covers the outer edge of the detection space and has the first opening, the second light shielding section disposed at a position that faces the first opening and is separated from the first opening by the first gap, and the third light shielding section disposed at a position separated from the first gap by the second gap on the imaginary line that is orthogonal to the direction in which the first opening and the second light shielding section face each other and passes through the first gap, and gas outside the light shielding section is allowed to flow into the detection space through the second gap, the first gap, and the first opening in order, the design parameter for determining the light shielding ability of the light shielding section (for example, the installation angle, the height, etc. of the first light shielding section, the second light shielding section, or the third light shielding section) and the design parameter for determining the gas inflow ability of the light shielding section (for example, the height of the first gap or the second gap, etc.) can be separated from each other, and a degree of freedom in design of the light shielding section can be improved when compared to a conventional technology.

Another embodiment of the present invention provides the alarm apparatus according to the above embodiment, wherein the first light shielding section and the third light shielding section are formed such that the first light shielding section and the third light shielding section overlap each other along a direction orthogonal to the direction in which the first opening and the second light shielding section face each other.

According to this embodiment, since the first light shielding section and the third light shielding section are formed such that the first light shielding section and the third light shielding section overlap each other in the direction orthogonal to the direction in which the first opening and the second light shielding section face each other, when compared to a case in which the first light shielding section and the third light shielding section are not formed to overlap each other, it is possible to inhibit the gas from directly flowing into the first gap without striking the first light shielding section, and it is possible to inhibit inflow of dust into the detection space.

Another embodiment of the present invention provides the alarm apparatus according to the above embodiment, wherein a second opening that allows the gas outside the light shielding section to flow into the second gap is formed in a portion in which the first light shielding section and the third light shielding section overlap each other.

According to this embodiment, since the second opening which allows the gas outside the light shielding section to flow into the second gap is formed at the portion in which the first light shielding section and the third light shielding section overlap each other, it is possible to cause the gas outside the light shielding section to flow into the detection space through the second opening, the second gap, the first gap, and the first opening in order. In particular, the shape of the second opening can be set in accordance with the shape of the portion in which the first light shielding section and the third light shielding section overlap each other, and the amount of gas allowed to flow into the detection space can be increased when compared to a conventional technology.

Another embodiment of the present invention provides the alarm apparatus according to the above embodiment, wherein the first light shielding section and the third light shielding section are integrally formed with each other, and the second light shielding section is formed separately from the first light shielding section and the third light shielding section.

According to this embodiment, since the first light shielding section and the third light shielding section are integrally formed with each other, and the second light shielding section is formed separately from the first light shielding section and the third light shielding section, when compared to a case in which the second light shielding section and the first light shielding section (or the third light shielding section) are integrally formed with each other, it is possible to simplify the structure of the second light shielding section, and it is possible to improve manufacturability of the second light shielding section.

Another embodiment of the present invention provides the alarm apparatus according to the above embodiment, wherein the first light shielding section and the second light shielding section are integrally formed with each other, and the third light shielding section is formed separately from the first light shielding section and the second light shielding section.

According to this embodiment, since the first light shielding section and the second light shielding section are integrally formed with each other, and the third light shielding section is formed separately from the first light shielding section and the second light shielding section, when compared to a case in which the third light shielding section and the first light shielding section (or the second light shielding section) are integrally formed with each other, it is possible to simplify the structure of the third light shielding section, and it is possible to improve manufacturability of the third light shielding section.

Another embodiment of the present invention provides the alarm apparatus according to the above embodiment, wherein the second light shielding section and the third light shielding section are integrally formed with each other, and the first light shielding section is formed separately from the second light shielding section and the third light shielding section.

According to the alarm apparatus of note 6, since the second light shielding section and the third light shielding section are integrally formed with each other, and the first light shielding section is formed separately from the second light shielding section and the third light shielding section, when compared to a case in which the first light shielding section and the second light shielding section (or the third light shielding section) are integrally formed with each other, it is possible to simplify the structure of the first light shielding section, and it is possible to improve manufacturability of the first light shielding section.

REFERENCE SIGNS LIST

1 Attachment base
2 Case
3 Detector cover
4 Detector body
5 Circuit unit
11 Attachment hook
12 Main body
12A Case-side facing surface
12B Installation surface-side facing surface
21 Back case
22 Front case
23 Outer inflow opening
31 Ceiling plate
31*a* Arrow
32 Labyrinth
33 Insect screen
34 Detection space
35 Light trap
36 Inner labyrinth
36*a* First side piece
36*b* Second side piece
36*c* Third side piece
36*d* Fourth side piece
36*e* Side piece
36*f* First inner inflow opening
37 Outer labyrinth
37*a* Second inner inflow opening
37*b* Fitting piece
38 First gap
39 Second gap
41 Flange portion
42 Inclined portion
43 Bulging portion
44 Detector body notch portion
45 Speaker accommodation portion

46 Element cover
47 Insertion hole
51 Circuit board
52 Light emitting unit
53 Light receiving unit
54 Shield
55 Switch
65 Rib
71 First incident portion
72 Second incident portion
81 First corner
82 Second corner
83 Third corner
100 Alarm apparatus
111 Screw hole
121 Screw hole
122 Engagement portion
211 Back case-side facing wall
211*a* Guiding recess
212 Back case-side outer circumferential wall
213*a* Slit
213*b* Slit
214 Engagement portion
221 Front case-side exposed wall
222 Front case-side outer peripheral wall
222*a* Front case-side end portion
223 Push button
224 Screw boss
225 Support
400*a* Detector body-side end portion
411 Positioning recess
431 Arrangement recess
611 Component case
612 Component case
613 Component case
613*a* Fixing screw
613*b* Insertion hole
614 Component case
614*a* Fixing screw
614*b* Insertion hole
615 Component case
616 Component case
621 Short fin
622 Short fin
623 Short fin
631 Long fin
632 Long fin
641 Prevention piece
642 Prevention piece
651 Rib
652 Rib
653 Rib
654 Rib
655 Rib
656 Rib
657 Rib
658 Rib
659 Rib
900 Installation surface
CN1 Power supply connector
BL Bisector
HL Imaginary line
F Arrow
L Arrow
LL Irradiation range of detection light
P1 to P6 Incident point
RV Field of view

The invention claimed is:

1. An alarm apparatus comprising:

a light shielding section for inhibiting ambient light from entering a detection space for detecting a substance to be detected contained in a gas, wherein the light shielding section includes a first light shielding section that covers an outer edge of the detection space and has a first opening, a second light shielding section disposed at a position facing the first opening, the position being separated from the first opening by a first gap, and a third light shielding section disposed at a position separated from the first gap by a second gap on an imaginary line orthogonal to a direction in which the first opening and the second light shielding section face each other, the imaginary line passing through the first gap, and the gas outside the light shielding section is allowed to flow into the detection space through the second gap, the first gap, and the first opening in order.

2. The alarm apparatus according to claim 1, wherein the first light shielding section and the third light shielding section are formed such that the first light shielding section and the third light shielding section overlap each other along a direction orthogonal to the direction in which the first opening and the second light shielding section face each other.

3. The alarm apparatus according to claim 2, wherein a second opening that allows the gas outside the light shielding section to flow into the second gap is formed in a portion in which the first light shielding section and the third light shielding section overlap each other.

4. The alarm apparatus according to claim 1, wherein the first light shielding section and the third light shielding section are integrally formed with each other, and the second light shielding section is formed separately from the first light shielding section and the third light shielding section.

5. The alarm apparatus according to claim 1, wherein the first light shielding section and the second light shielding section are integrally formed with each other, and the third light shielding section is formed separately from the first light shielding section and the second light shielding section.

6. The alarm apparatus according to claim 1, wherein the second light shielding section and the third light shielding section are integrally formed with each other, and the first light shielding section is formed separately from the second light shielding section and the third light shielding section.

* * * * *